US006859122B2

(12) United States Patent
Divoux et al.

(10) Patent No.: US 6,859,122 B2
(45) Date of Patent: Feb. 22, 2005

(54) MAGNETIC ACTUATOR WITH SHORT RESPONSE TIME

(75) Inventors: Claire Divoux, Grenoble (FR); Pierre Gaud, Coubiene (FR); Jérôme Delamare, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/482,095

(22) PCT Filed: Jun. 24, 2002

(86) PCT No.: PCT/FR02/02176

§ 371 (c)(1),
(2), (4) Date: Dec. 22, 2003

(87) PCT Pub. No.: WO03/001548

PCT Pub. Date: Jan. 3, 2003

(65) Prior Publication Data

US 2004/0246082 A1 Dec. 9, 2004

(30) Foreign Application Priority Data

Jun. 25, 2001 (FR) ..... 01 08324

(51) Int. Cl.[7] ..... H01F 51/22

(52) U.S. Cl. ..... 335/78; 335/80; 335/84; 335/336; 29/607

(58) Field of Search ..... 335/78–85, 236, 335/237; 29/607; 200/181

(56) References Cited

U.S. PATENT DOCUMENTS 5,150,090 A * 9/1992 Miura et al. ..... 335/84
6,094,116 A 7/2000 Tai et al. ..... 335/78
6,124,650 A 9/2000 Bishop et al. ..... 310/40

FOREIGN PATENT DOCUMENTS

WO 97/39468 10/1997 ..... H01H/51/22

OTHER PUBLICATIONS

Rogge et al., "Fully Batch Fabricated Magnetic Microactuators Using a Two Layer Liga Process", Jun. 25–29, 1995, The 8th International Conference on Solid State Sensors and Actuators, and Eurosensors IX, Stockholm, Sweden, pp. 320–323.

* cited by examiner

*Primary Examiner*—Ramon M. Barrera
(74) *Attorney, Agent, or Firm*—Thelen Reid & Priest LLP

(57) ABSTRACT

Magnetic actuator having a closed magnetic circuit (26) capable of guiding a magnetic flux. The magnetic circuit (26) comprises a fixed magnetic part (30, 31, 32) with a yoke (30) and a mobile part (22), magnetically connected to each other and also at least one main air gap (29) delimited by at least one portion (28) of the mobile part (22) and by the yoke (30). In the main air gap (29), the flux is closed by being set up approximately transverse to the mobile part (22). The fixed part (30, 31, 32) also comprises flux recuperation means (40) that contribute with the mobile part (22) to delimiting an auxiliary air gap (38) in which the magnetic flux is set up laterally to the mobile part (22). The flux is contained on each side of the main air gap (29), on one side by the yoke (30), and on the other side jointly by the mobile part (22) and the flux recuperation means (40) through the part (28) contributing to delimiting the main air gap (29). The auxiliary air gap (38) has a dimension in the direction in which magnetic flux is set up that is minimum in at least one area of the portion (28) contributing to delimiting the main air gap (29).

24 Claims, 16 Drawing Sheets

MAGNETIC ACTUATOR WITH SHORT RESPONSE TIME

CROSS-REFERENCE TO RELATED APPLICATION

This application claims priority based on International Patent Application No. PCT/FR02/02176, entitled "Magnetic Actuator with Short Response Time" by Claire Divoux, Pierre Gaud and Jerome Delamare, which claims priority of French application no. 01 08324, filed on Jun. 25, 2001, and which was not published in English.

TECHNICAL FIELD

This invention relates to magnetic actuators, including miniature and larger actuators. Micro-actuators is the term used for miniature actuators. The manufacture of this type of actuators is based on mechanical structure machining techniques, micro-machining techniques and other techniques used in microelectronics.

These actuators are used particularly to make electrical, optical, power and high frequency relays, selector switches, and also to make pumps, valves, motors. A selector switch is a device with several contacts that can close separately, while the relay only has one or several contacts that close at the same time. These contacts may be in the open or closed position.

Electromagnetic relays and miniaturised or non-miniaturised selector switches are widely used in many applications such as telecommunications in transmission and in reception, in optical telecommunications, in automatic test equipment, automobiles, aeronautics and general public electronic devices.

Pumps, valves and motors can be used in many application fields, and particularly in microbiology, medicine, optics, etc.

State of prior art

Known types of actuators comprise a fixed magnetic part 1 and a mobile magnetic part 2 that cooperate with each other. The fixed magnetic part 1 is magnetically connected to the mobile magnetic part.

Refer to FIG. 1 that shows an example known type of magnetic actuator with a single air gap.

The fixed magnetic part 1 and the mobile magnetic part 2 form a magnetic circuit 6 closed on itself and capable of guiding a magnetic flux. The fixed magnetic part 1 and the mobile magnetic part 2 are stacked on each other. The magnetic circuit 6 cooperates with the means 7 of generating the magnetic flux. The fixed magnetic part comprises a portion 12 and the mobile magnetic part 2 comprises a portion 8 contributing to delimiting an air gap 9 so that a force can be applied on portion 8 of the mobile part 2 to move it under the effect of the magnetic field.

In the air gap 9, the magnetic flux is established transverse to the portion 8. In this example, the fixed magnetic part 1 comprises a base or yoke 10 extended by a first magnetic stud 11 and a second magnetic stud 12. The second magnetic stud 12 contributes to delimiting the air gap 9.

The yoke 10 is magnetically connected to the mobile magnetic part 2 through the first stud 11. It also performs a role to mechanically retain the mobile magnetic part 2 with respect to the fixed magnetic part 1. The fixed magnetic part 1 and the mobile magnetic part 2 are extended one above the other in planes approximately parallel to each other when the actuator is in the open position.

The closed loop magnetic circuit 6 comprises the yoke 10, the first magnetic stud 11, the mobile part 2, the air gap 9 and the second magnetic stud 12, in a closed loop one after the other, in a direction of circulation of the magnetic flux. Its reference 6 diagrammatically shows the path followed by the magnetic flux as it passes through its various components.

In the example, the mobile magnetic part 2 is in the form of an arm with a support end 13 connected to the first magnetic stud 11 and another free end that corresponds to the portion 8 contributing to delimiting the air gap 9 in the example.

In electric relays, the free end is used as an electrical contact, regardless of whether the arm is made of an electrical conducting material or is fitted with an electrical contact. No electrical contact is shown.

The means 7 for generating the magnetic flux may include one or several windings surrounding one or several portions of the fixed magnetic part and/or the mobile magnetic part 2 and/or possibly one or several permanent magnets. A magnetic flux is produced when an electric current circulates in one of the windings. It is materialised by the closed loop shown with arrows.

In the example in FIG. 1, a winding 7 is shown around the first magnetic stud 11. Several windings could be used. They could be arranged around the yoke 10, around the second magnetic stud 12, or even around the mobile magnetic part 2.

In this type of magnetic circuit 6, a compromise has to be found between the sections transverse to the flux in its different parts; namely in the mobile magnetic part 2, in the fixed magnetic part 1 and in the air gap 9.

An attempt is made to obtain a large induction value at the air gap 9 such that the force that will be applied to the mobile magnetic part 2 at the portion 8 is large. To achieve this, the available magnetic flux in the air gap 9 must be large. The available magnetic flux in the air gap 9 corresponds to the flux guided by the magnetic circuit 6 on each side of the air gap 9. The maximum magnetic flux that can be guided by a part made from a magnetic material depends on the magnetic material and the cross section of the part.

In the unsaturated state of the magnetic material, the magnetic losses decrease as the section increases, and in the saturated state of the magnetic material, not all the generated magnetic flux can be contained and the excess magnetic flux corresponds to losses, it cannot be guided by the magnetic material and only very slightly contributes to the force.

The section of the magnetic circuit 6 may be approximately homogenous over its entire length. In this case, the mechanical performances of the actuator are mediocre.

In general, the section of the mobile magnetic part 2 is less than the section of the fixed magnetic part 5 for mechanical reasons. An attempt is made to ensure that the stiffness of the mobile part 2 is not too great for it to bend easily. One method of reducing the stiffness of the mobile part is to reduce its section. This reduction in the section of the mobile part is made at the detriment of the possibility of the magnetic flux passing in the mobile magnetic part, which reduces the force at the air gap and increases the response time of the mobile part.

There are other types of magnetic actuators for which there are several air gaps.

In these types of actuators, the main air gap will be the air gap delimited by surfaces transverse to the direction of movement of the mobile magnetic part. In these configurations, there is at least one other air gap that will be referred to as the auxiliary air gap.

FIG. 2 is a top view illustrating a micro-relay. This micro-relay is flat and is no longer stacked. It was described in the article entitled "Fully Batch Fabricated Magnetic Microactuators Using A Two Layer LIGA Process" by B. ROGGE, J. SCHULZ, J. MOHR, A. THOMMES and W. MENZ in TRANSDUCERS 95—EUROSENSORS IX pages 320 to 323.

It now comprises the fixed magnetic part 1 and the mobile magnetic part 2 on a common support 3. The mobile magnetic part 2 corresponds to a free end 17 of a mobile arm 5 for which the other end 13 is a bearing end fixed to support 3. The arm 5 and the fixed magnetic part 1 are located adjacent to each other in approximately the same plane, parallel to the plane of the support 3. The movement is made in the plane of the arm 5 and of the fixed magnetic part 1.

The free end 17 is terminated in a mobile electrical contact 16 that will come into contact with a fixed electrical contact 15 supported on support 3.

In this example, the fixed magnetic part 1 comprises a yoke 10 fixed on one side to a magnetic stud 12 that contributes to delimiting the main air gap 9 from the mobile magnetic part 2. At the other side, the yoke 10 is fixed to a magnetic extension 14, in this example in the form of an arm facing the magnetic stud 12. This magnetic stud 12 and the magnetic extension 14 delimit an auxiliary air gap 18.

The magnetic circuit 6 then comprises the yoke 10, the first magnetic stud 12, the second air gap 18, the magnetic extension 14 and the air gap 9 and the mobile magnetic part 2 in parallel. The low stiffness of the arm 5 requires a low return force that correspondingly slows the arm repulsion movement.

It can be understood that this micro-relay does not operate optimally, since the force applied to the mobile part is very limited.

As before, the magnetic circuit 6 cooperates with means 7 for generating the magnetic flux. They are shown as one winding around the yoke 10 and another winding around its extension 14.

Patent application WO-97/39468 also describes an electrical relay like that shown in FIGS. 3A and 3B. These two figures are not shown at the same scale.

Instead of being planar, the construction of this relay is stacked. There are the fixed magnetic part 1 and the mobile magnetic part 2 that cooperate with each other. The mobile magnetic part 2 is a portion of a larger mobile part 5, but this larger part is only shown in outline in the figures. Its connection to a fixed element, for example that may be a support on which the fixed magnetic part 1 is supported, is not shown. The reason for not showing it is that the connection with the fixed element does not play a magnetic role.

In this example, the fixed magnetic part 1 comprises a yoke 10 that is extended in a central area by a central magnetic stud 12 that contributes to delimiting the main air gap 9 with the mobile magnetic part 2. It is assumed that the mobile magnetic part 2 corresponds essentially to the cross-hatched part of FIG. 3A and that is in the form of a plate. The yoke 10 is also fixed to two magnetic extensions 14 on each side of the central stud 12, that project towards the mobile magnetic part 2. These extensions 14 terminate facing each other close to the mobile magnetic part 2, and each contributes to delimiting an auxiliary air gap 18 with the mobile magnetic part 2.

The magnetic circuit 6 then comprises the yoke 10, one of the extensions 14, the auxiliary air gap 18, the mobile magnetic part 2, the main air gap 9 and the central magnetic stud 12, one after the other. The extensions 14 are used simply for better guidance of the magnetic flux adjacent to the mobile magnetic part 2. It is the only means of guiding the flux and an additional air gap is created. There is no direct means of guiding the flux.

The magnetic flux that circulates in the magnetic circuit 6 follows two closed loops that join together in the central stud 12. These two loops are symmetric if the magnetic circuit is symmetric with respect to a median axis passing through the central stud 12 in the direction of movement.

In this example, the mobile magnetic part 2 conducts electricity, it acts as an electrical contact that closes an electrical circuit when it comes close to the central stud 12 under the effect of the induced force. This electrical circuit is terminated by two fixed contacts 15 inserted between the central magnetic stud 12 and the mobile magnetic part 2. These fixed electrical contacts increase the size of the air gap.

As before, the magnetic circuit 6 cooperates with the means 7 to generate the magnetic flux. They are represented by a winding surrounding the central magnetic stud 12.

In this configuration, the magnetic flux in the main air gap 9 is not optimum, because when an attempt is made to close the actuator, the magnetic flux located in the yoke 10 is guided towards the extensions 14, but not all this flux passes through the mobile magnetic part 2 to the main air gap 9, and there are large flux leakages that occur between the extensions 14 and the yoke 10, through the central stud 12 without passing through the mobile magnetic part 2 or the main air gap 9.

Presentation of the invention

The purpose of this invention is to make an electromagnetic actuator for which the force applied to the mobile part and the speed are higher than in conventional actuators and that prevents damping of the mobile magnetic part. This type of actuator provides a large displacement force while keeping a reduced section for the mobile part such that its mechanical properties are compatible with a shorter mechanical response time.

To achieve this, this invention proposes a magnetic actuator with a closed magnetic circuit capable of guiding a magnetic flux, this magnetic circuit comprising a fixed magnetic part with a yoke and a mobile magnetic part, magnetically connected to each other, and also at least one main air gap delimited by at least one portion of the mobile magnetic part and by the yoke and in which the magnetic flux is closed by being set up approximately transverse to the mobile magnetic part. The fixed magnetic part also comprises flux recuperation means that contribute with the mobile magnetic part to delimiting an auxiliary air gap in which the magnetic flux is set up laterally to the mobile magnetic part, the magnetic flux being contained on each side of the main air gap, on one side by the yoke, and on the other side jointly by the mobile magnetic part and the flux recuperation means through the part contributing to delimiting the main air gap, the auxiliary air gap having a dimension in the flux creation direction that is minimum in at least one area of the portion contributing to delimiting the main air gap.

At least one first magnetic stud is used to connect the yoke mechanically and magnetically to the mobile magnetic part.

At least one second magnetic stud contributes to delimiting the main air gap, this magnetic stud being output either from the yoke or from the mobile magnetic part. Advantageously, this magnetic stud is made from a material with hysteresis.

At least one other magnetic stud is used to mechanically and magnetically connect the yoke to the flux recuperation means.

The actuator comprises means for generating the magnetic flux in the closed magnetic circuit, and these means for generating the magnetic flux may be made by at least one winding.

To avoid unwanted lateral displacements of the mobile magnetic part, it may globally be in the form of at least one arm with one or several non-parallel branches connected to each other at the portion contributing to delimiting the main air gap.

The flux recuperation means may globally be in the form of at least one arm with one or several branches.

The mobile magnetic part could be in the form of a star with several branches.

It is preferable if the flux recuperation means in the direction of movement of the mobile magnetic part are thicker than the mobile magnetic part in the displacement direction, so that the auxiliary air gap is delimited by surfaces that remain facing each other during the movement, in order to avoid the development of parasite forces on the portion that contributes to delimiting the main air gap.

Knowing that the main air gap is defined by two facing surfaces, the first surface forming part of the portion of the mobile magnetic part and the second surface forming part of the yoke, it is preferable if the first surface is larger than the second surface and projects all around the second surface, in order to limit the direct leakage flux between flux recuperation means and other fixed parts of the closed magnetic circuit.

The size of the auxiliary air gap in the direction in which the magnetic flux is set up can be practically maximum close to the portion contributing to delimiting the main air gap, and can decrease as the distance from this portion increases, in order to efficiently avoid damping.

The mobile magnetic part may comprise at least one through opening in the direction of a displacement in the mobile magnetic part, so as to reduce damping even further.

The actuator may be of the stacked type, the yoke forming a first level and the assembly formed by the flux recuperation means and by the mobile magnetic part forming a second level.

It is preferable if at least one of the levels has an oblong shape approximately rounded at its two ends, in order to limit flux leakages.

For the same reason, it is preferable if the two levels overlap. At least one of the levels may comprise at least one central through opening.

The actuator may be approximately symmetric about a median plane passing through the mobile magnetic part approximately perpendicular to the movement direction.

The actuator may be used to close or open an electric circuit. The portion contributing to delimiting the main air gap may comprise at least one electrical contact that will contact at least one other electrical contact when the actuator is closed.

According to another embodiment, the mobile magnetic part may be terminated by at least one electrical contact offset from the portion contributing to delimiting the main air gap, this electrical contact being designed to contact at least one other electrical contact when the actuator is closed.

The electrical contact may be electrically isolated from the mobile magnetic part.

The mobile magnetic part may be made of an electrically conducting magnetic material.

This invention also relates to a method for making a magnetic actuator comprising the following steps:

- etch a caisson in a substrate to be filled with a magnetic material to make a yoke from a fixed magnetic part,
- deposit a first dielectric layer on the substrate with the yoke,
- etch at least one caisson to delimit the means for generating a magnetic flux and deposit the said means,
- deposit a second dielectric layer on the first layer,
- etch caissons through the two layers reaching the yoke to delimit at least one first magnetic stud and at least one second magnetic stud, the second stud contributing to delimiting at least one main air gap,
- deposit first and second magnetic studs in the caissons,
- deposit a sacrificial layer on the second dielectric layer and etch the sacrificial layer to expose the first magnetic stud and to make a separation between a mobile magnetic part and flux recuperation means of the fixed magnetic part, deposited later,
- deposit magnetic material on the sacrificial layer to make the mobile magnetic part and flux recuperation means, then etch the magnetic material to delimit them,
- eliminate the sacrificial layer under the mobile magnetic part to expose it and make the main air gap.

This invention also relates to a relay comprising a magnetic actuator thus defined.

This invention also relates to a selector switch comprising at least one magnetic actuator thus defined so as to have several air gaps.

This invention also relates to a pump comprising a magnetic actuator thus defined, in which the mobile magnetic part is fixed to a membrane that contributes to delimiting a cavity in which a fluid can be circulated.

BRIEF DESCRIPTION OF THE DRAWINGS

Other special features and advantages of the invention will become clear after reading the following description illustrated by the attached figures.

DETAILED PRESENTATION OF PARTICULAR EMBODIMENTS

Figure 1:
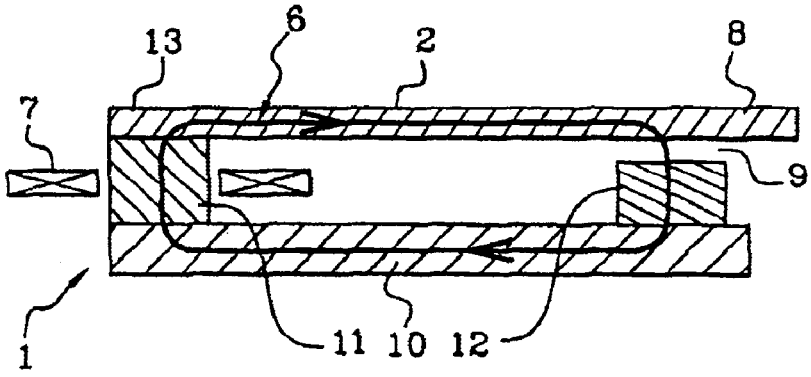
Fig. 1 PRIOR ART
FIG. 1 (already described) shows a longitudinal sectional view through a known magnetic actuator.
Figure 2:
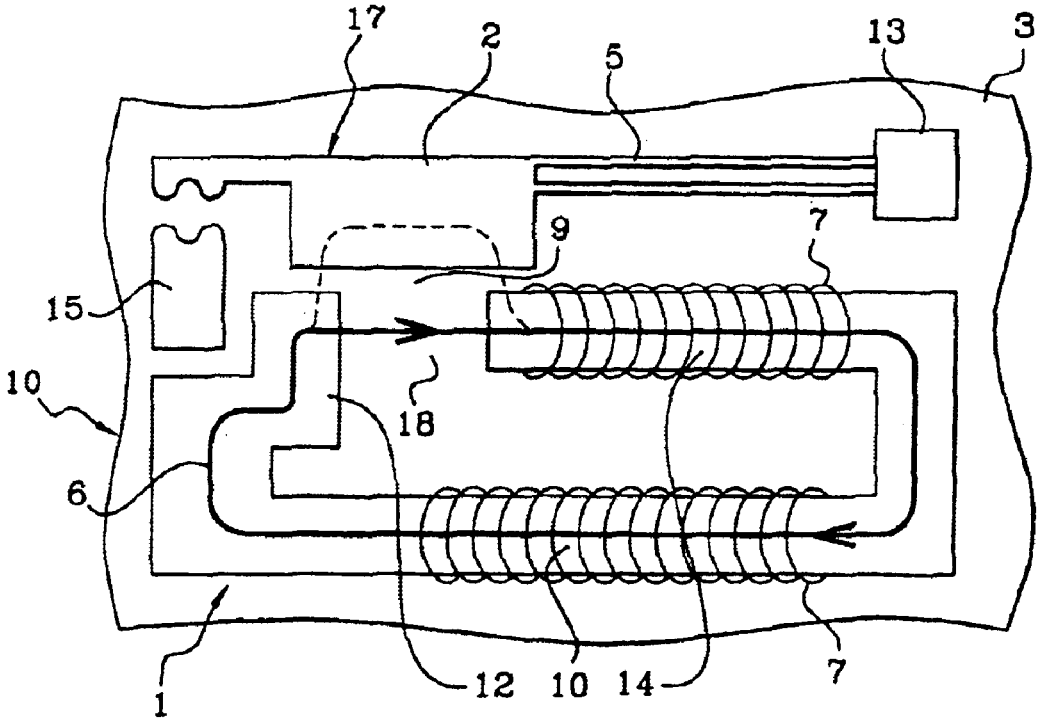
Fig. 2 PRIOR ART
FIG. 2 (already described) shows a top view of another known magnetic actuator.
Figure 3A:
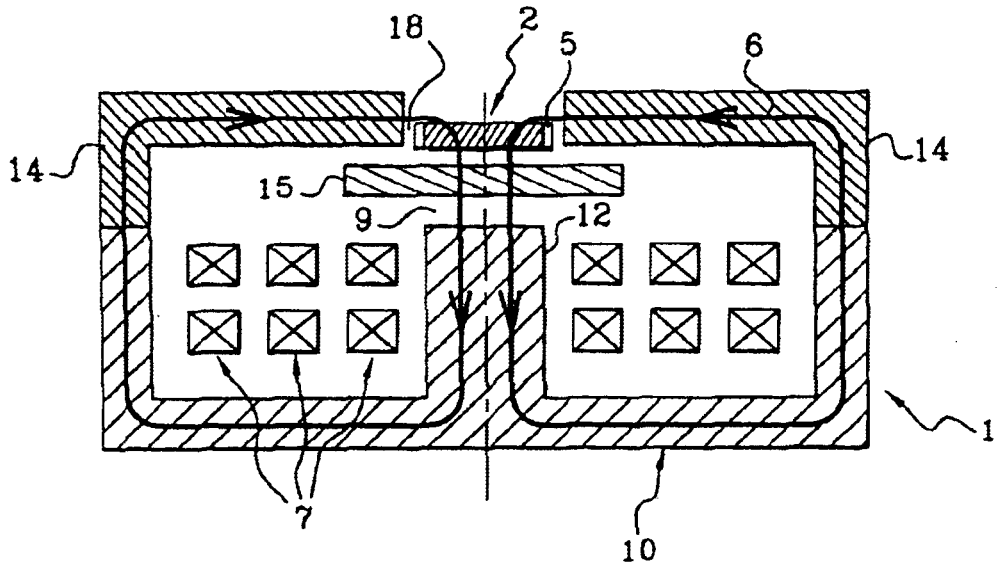
Fig. 3A PRIOR ART
FIGS. 3A and 3B (already described) show a longitudinal sectional view and a top view of a third known magnetic actuator, respectively.
Figure 3B:
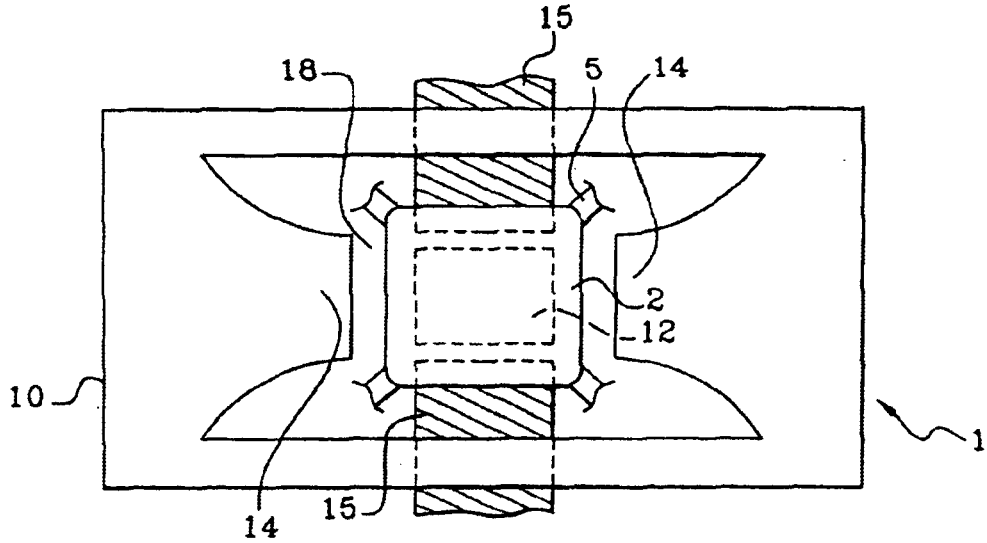
Fig. 3B PRIOR ART

FIGS. 4A to 4D show a top view, a cross-sectional view along axis BB, a cross-sectional view along axis CC, and a bottom view respectively, of a magnetic actuator according to the invention. For example, this type of actuator could be a micro-relay usable particularly in mobile telephones. It is made in micro-technology with stacked layers.

In this configuration, the closed magnetic circuit 26 capable of guiding a magnetic flux is diagrammatically represented by bold arrows. It comprises a fixed magnetic part 21 and a mobile magnetic part 22 electrically connected to each other.

The fixed magnetic part 21 comprises an approximately plane yoke or base 30 that is extended on one side by a first magnetic stud 31 that will magnetically connect the fixed magnetic part 21 to the mobile magnetic part 22. On the other side, it is extended by a second magnetic stud 32 that contributes to delimiting a main air gap 29 between the fixed magnetic part 21 and a portion 28 of the mobile magnetic part 22. It also comprises flux recuperation means 40 that will be described in detail later.

The mobile magnetic part 22 is in the form of approximately plane arms with a bearing end 33 fixed to the first magnetic stud 31 and terminating in a free end. In this example, the free end corresponds to the portion 28 that contributes to delimiting the main air gap 29. This portion 28 has a maximum amplitude during a displacement of the mobile magnetic part 22. This portion 28 is facing the second magnetic stud 32; and the force generated during actuation is applied on this portion.

The first magnetic stud 31 also performs a mechanical role to anchor the mobile magnetic part 22 to the fixed magnetic part 21. This anchorage may be made by embedment or by articulation. The first magnetic stud may be made entirely or partly of a magnetic material.

The second magnetic stud 32 that contributes to delimiting the main air gap 29 may act as an electrical contact for an electrical relay application.

The second magnetic stud may be made from a material with hysteresis, for example it may be made from electrolytic deposition of a cobalt alloy. This embodiment puts the actuator into a stable state.

The two magnetic studs 31, 32 are located at the two ends of the yoke 30.

In the main air gap 29, the magnetic flux is closed by being set up transversely to the plane of the mobile magnetic part 22.

According to one characteristic of the invention, the fixed magnetic part 21 comprises flux recuperation means 40, magnetically connected with the yoke 30, that delimit at least one lateral auxiliary air gap 38 with the mobile magnetic part 22 in which the magnetic flux is set up laterally to the mobile part 22. In this example, the magnetic connection between the yoke 30 and the flux recuperation means 40 is made through the first magnetic stud 31.

Means for generating the magnetic flux 27 may be made by one or several windings placed around the closed magnetic circuit 26. One or several additional permanent magnets may be provided to replace or to complement the windings.

The means for generating the magnetic flux are not shown in FIGS. 4 for reasons of clarity, but they are visible in FIGS. 5 described later. They can be placed around the yoke, the magnetic studs, the flux recuperation means and even the mobile magnetic part, if they do not hinder the movement.

The flux recuperation means 40 such as an arm with two branches 41, approximately flat with one end 40.1 not magnetically connected and one bearing end 40.2 magnetically and mechanically connected to the yoke 30 through the first magnetic stud 31, are shown in the example in FIGS. 4. The flux recuperation means 40 are located in approximately the same plane as the mobile magnetic part 22.

The two branches 41 are adjacent to the two ends of arm 40. The two branches delimit a space in which the mobile magnetic part 22 fits. In this example, the mobile magnetic part 22 and the flux recuperation means 40 are fixed to the same first magnetic stud 31, but several studs could be present. The flux recuperation means 40 surround the fixed magnetic part 22 and the lateral auxiliary air gap 38 that they contribute to delimiting, is adjacent to the mobile magnetic part 22 from its built-in bearing end 33 as far as the portion 28 contributing to delimiting the main air gap 29.

The flux recuperation means 40 cooperate with the mobile magnetic part 22. They recover part of the magnetic flux set up in the main air gap 29 that, when the mobile magnetic part 22 is in a saturated state, cannot be guided by it. This may be the case when the main air gap 29 is small, for example when the relay is being closed, particularly for thin layer materials, for example deposited electrolytically and for which the induction value at saturation is low.

The magnetic flux circulation is represented in FIGS. 4. The magnetic flux that is set up in the auxiliary air gap 38 is directed approximately transverse to the magnetic flux set up in the main air gap 29 and is therefore approximately transverse to the movement.

By creating an analogy with an electrical circuit, the closed magnetic circuit 26 thus formed comprises a segment comprising flux recuperation means 40 and the mobile magnetic part 22 installed in parallel, this segment being in series with another segment comprising the first magnetic stud 31, the yoke 30, the second magnetic stud 32 and the main air gap 29 installed in series.

The flux recuperation means 40 increase the section of the magnetic circuit in the part corresponding to the mobile magnetic part and therefore the magnetic flux that can be guided is greater than if there were no recuperation means. These flux recuperation means 40 are used before, during and after the movement of the mobile magnetic part 22.

It is then possible to provide the mobile magnetic part 22 with a section adapted to the required mechanical constraints without introducing the risk of saturation, since saturation no longer corresponds to a reduced force applied to the portion 28 contributing to delimiting the main air gap 29 or to a long response time.

Due to the presence of flux recuperation means 40, the magnetic flux that is set up in a small main air gap 29 and the applied force may be increased. There is less magnetic flux that cannot be guided due to saturation.

For a larger main air gap, the reluctance of the magnetic circuit 26 is reduced by the magnetic elements set up and the gain in the magnetic flux and force are appreciable. Remember that the reluctance of a magnetic circuit is the equivalent of the resistance of an electrical circuit.

In all cases, the gain in the magnetic force causes a reduction in the mechanical switching time.

Figure 4A:
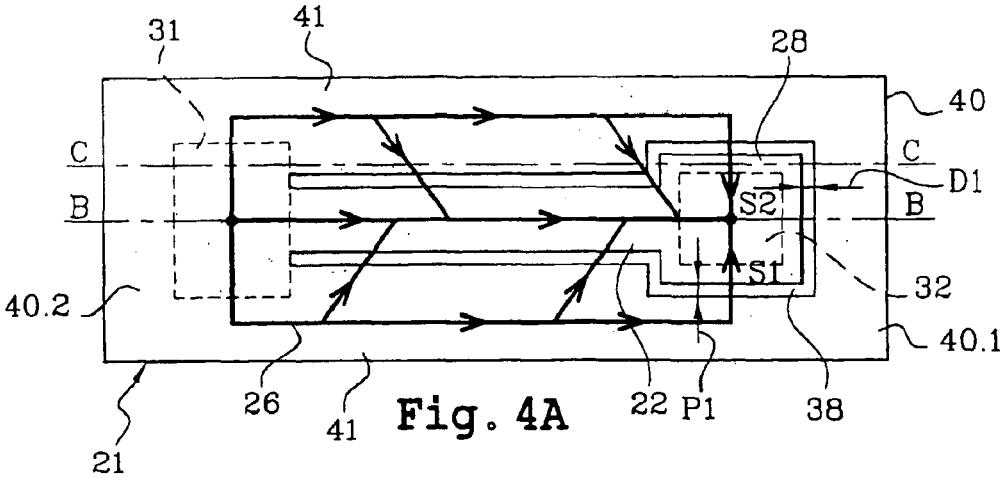
FIGS. 4A to 4D show a top view, a longitudinal sectional view along axis BB, a longitudinal sectional view along axis CC, and a bottom view respectively, of a magnetic actuator according to the invention.
Figure 4B:
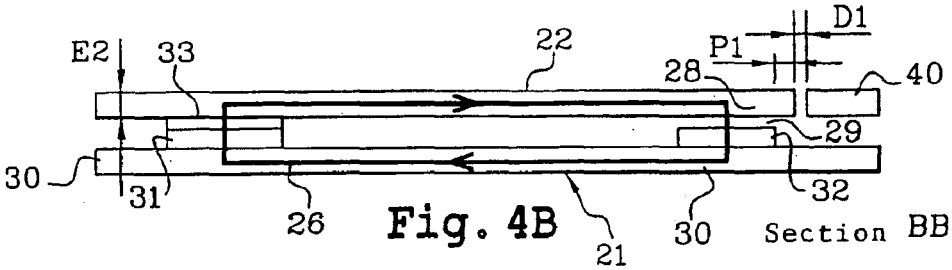
Figure 4C:
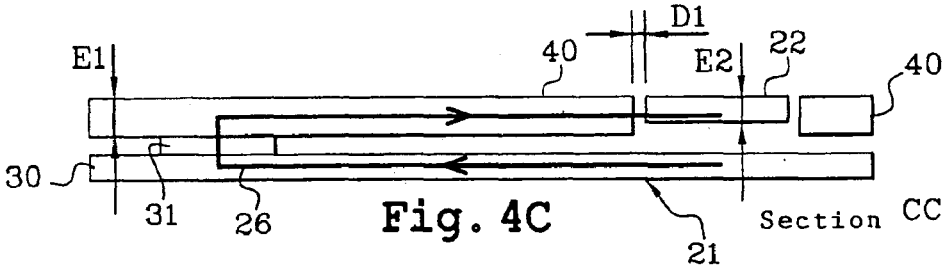
Figure 4D:
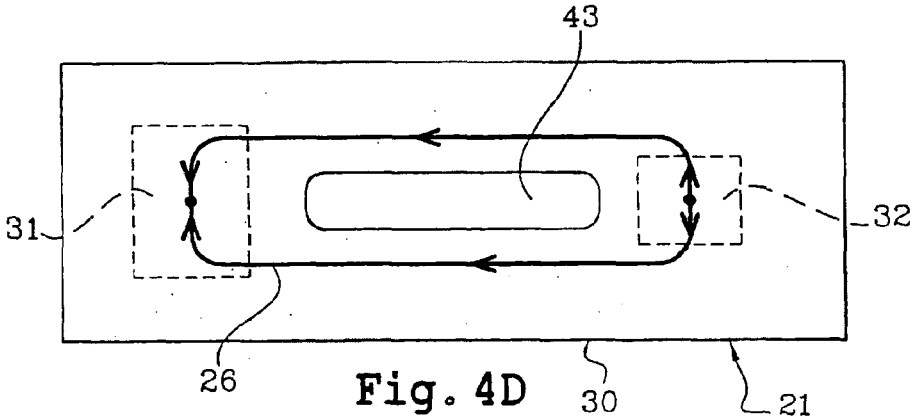

The increased distance between the mobile magnetic part 22 and the flux recuperation means 40 characterises the auxiliary air gap 38. It may be approximately constant as shown in FIG. 4A. However, it is preferable that it should be adjusted to vary the flux passage and to optimise the force applied to the portion with maximum amplitude 28 and avoid damping. It is preferable if dimension D1 of the auxiliary air gap 38 in the direction in which the magnetic flux is set up, should be minimum at least at one area of portion 28 contributing to delimiting the main air gap.

Still with the purpose of optimising the value of the force applied to the mobile magnetic part 22, it is preferable to limit the appearance of parasite forces between flux recuperation means 40 and the mobile magnetic part 22.

When a magnetic flux is being set up in two magnetic elements, forces related to reluctant effects tend to align the two magnetic elements in the direction of magnetic induction. If the flux recuperation means 40 and the mobile magnetic part 22 have the same dimension in the movement direction, an offset between them is developed during actuation and this offset may cause the surfaces delimiting the auxiliary air gap 38 to be no longer facing each other. The mobile magnetic part 22 is then subjected to a Lorentz force that opposes its displacement and can disturb operation of the actuator.

To avoid this phenomenon, it is preferable if the thickness E1 of the flux recuperation means 40 in the movement direction should be greater than the thickness E2 of the mobile magnetic part 22, such that the surfaces delimiting the auxiliary air gap 38 remain facing each other.

It is also preferable to delimit the direct leakage flux between flux recuperation means 40 and the other fixed parts of the closed magnetic circuit 26, particularly the second magnetic stud 32.

The main air gap 29 is delimited by the portion 28 of the mobile magnetic part 22 that has a surface S1 and by the second magnetic stud 32 of the yoke 30 that has a surface S2 facing the surface S1. The surface S1 can be larger than the surface S2, and can project beyond the surface S2 around its periphery, in order to limit the leakage flux. The surface S1 projects by a distance P1 beyond the surface S2.

The magnetic flux contained in recuperation means 40 then passes more easily in the portion 28 of the mobile magnetic part 22 than in the second stud 32.

Figure 5A:
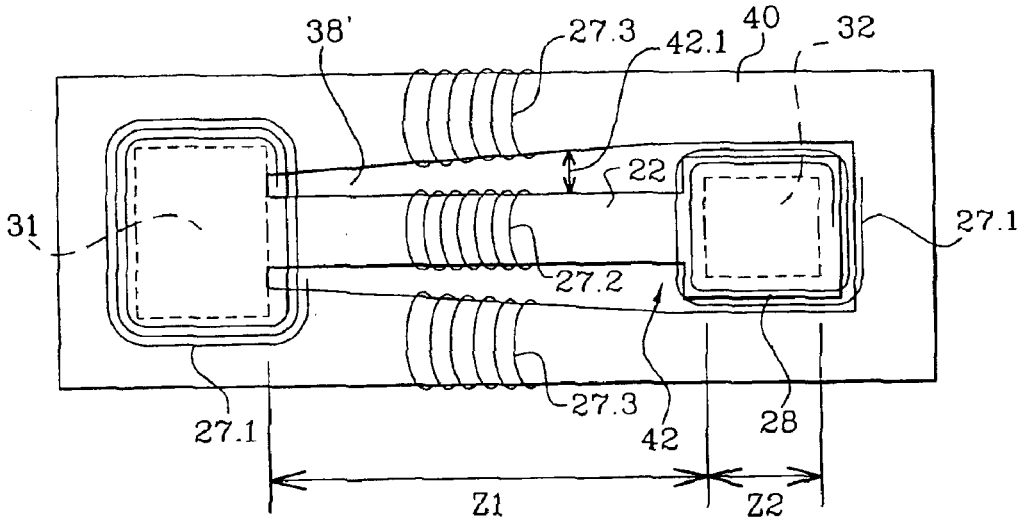
FIGS. 5A to 5D show top views of magnetic actuators according to the invention, provided with means for preventing damping of the mobile magnetic part during its displacement.
Figure 5B:
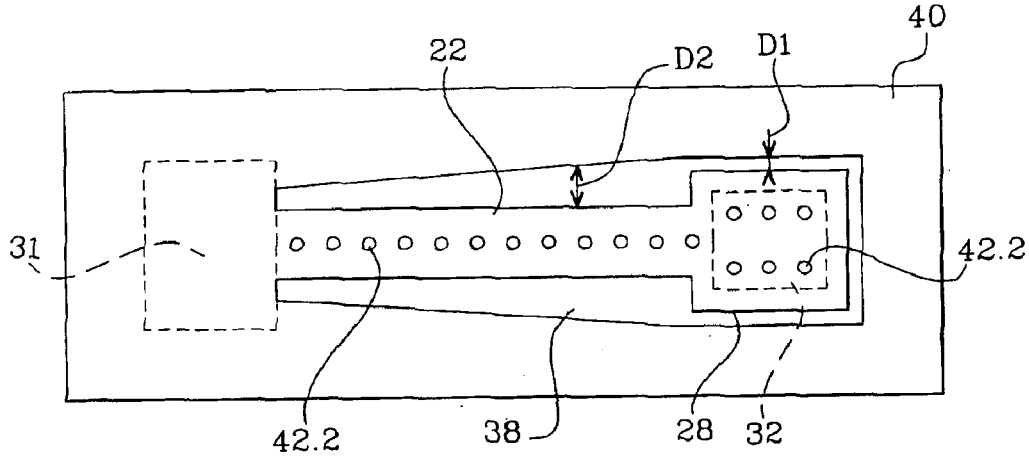

We will now consider FIGS. 5A and 5B showing a top view of two variants of a magnetic actuator according to the invention. These figures are comparable to FIG. 4A in as far as the global shape of the mobile magnetic part 22 and magnetic flux recuperation means 40 are concerned.

FIG. 5A shows means for generating a magnetic flux 27 in the form of one or several windings 27.1 to 27.3. There are many possible ways of arranging them and making them. This example shows a winding 27.1 around each of the studs 31, 32 a winding 27.2 around the arm forming the mobile magnetic part 22, and a winding 27.3 around each of the branches 41 of the flux recuperation means 40.

Figure 6A:
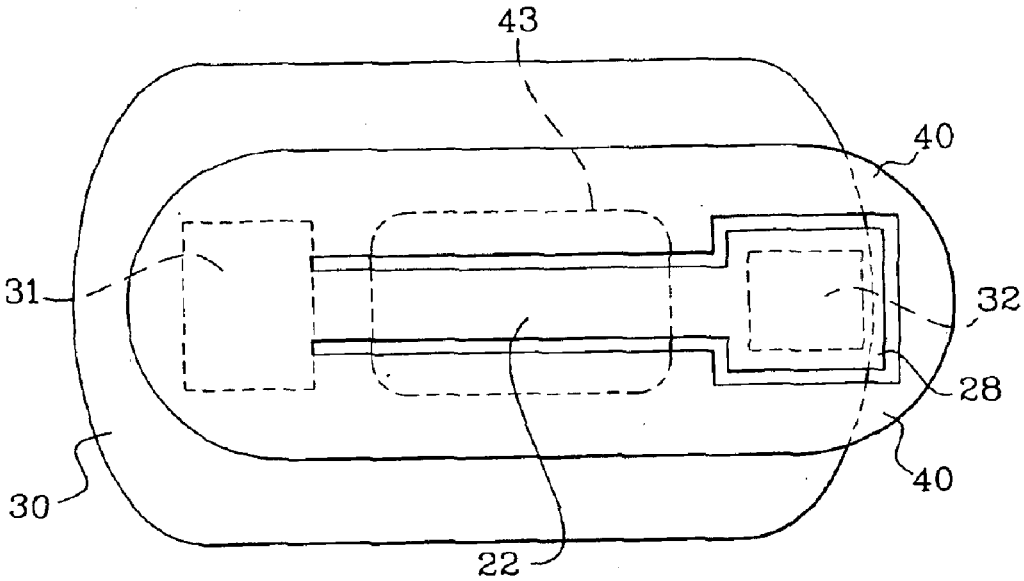
FIGS. 6A and 6B show a top view and a bottom view respectively of a magnetic actuator according to the invention, with limited leakage flux.
Figure 6B:
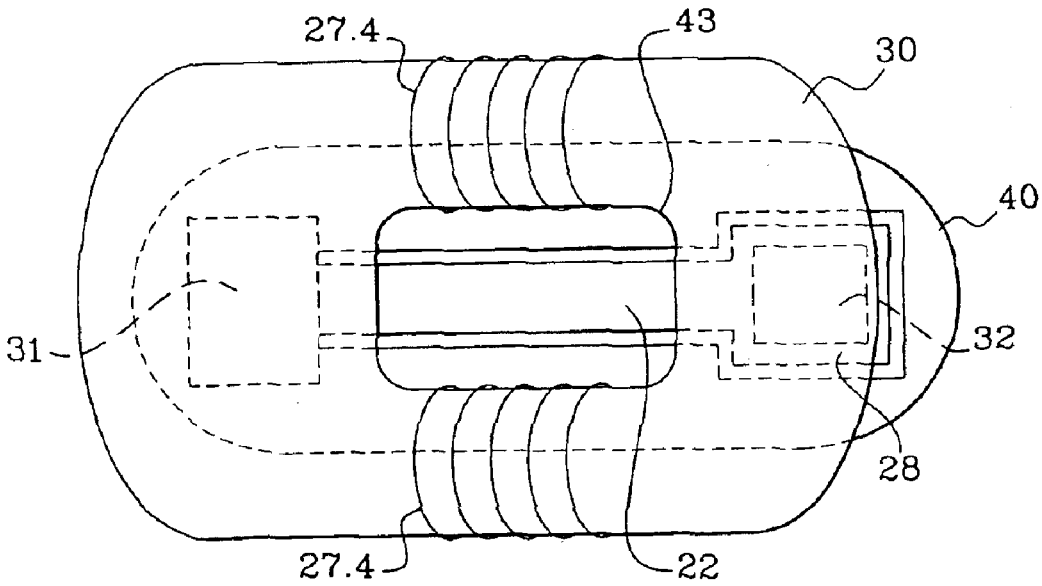

It is assumed that the windings 27.1 associated with the studs 31, 32 are spiral windings. This winding type is compatible with micro-technologies and is easy to make. Windings 27.2, 27.3 around the arm and branches have been shown as solenoids. One or several windings 27.4, for example of this type, can be associated with the yoke 40 as shown in FIG. 6B.

In order to further reduce the response time of the actuator according to the invention, it is preferable to provide means for preventing damping of the mobile magnetic part 22 during its displacement. These means encourage the escape of air located in the main air gap 29 when the effect of the movement of the mobile magnetic part 22 is to reduce the main air gap 29.

These means 42.1 can consist of providing one or several first zones Z1 along the mobile magnetic part 22 in which the magnetic flux recuperation means 40 are further away than in one or several second zones Z2.

In order to optimise the force applied to the portion 28 that delimits the main air gap 29 and to prevent damping of the mobile magnetic part 22, the auxiliary air gap 38 has a dimension in the direction in which the magnetic flux is set up that is minimum in at least one area of portion 28 contributing to delimiting the main air gap 29. Therefore, it is greater in at least one zone outside the said portion 28.

In the example shown in FIGS. 5A and 5B, the mobile magnetic part 22 is an arm that terminates in portion 28, this portion being wider than the arm. The distance D2 between the flux recuperation means 40 and the mobile magnetic part 22 is practically maximum close to portion 28 and it decreases as the distance from it increases. The distance D1 at portion 28 is minimum as was seen above. The minimum dimension D1 shown in FIGS. 5A, 5B exists all around the portion 28.

If the dimension of the auxiliary air gap is approximately constant, air could remain trapped in the mobile magnetic part 22, which would dampen its movement.

These means for improving the exhaust may also consist of providing the mobile magnetic part 22 with through openings 42.2 in the movement direction. This configuration is illustrated in FIG. 5B in combination with the adjustment of the distance between the mobile magnetic part 22 and the flux recuperation means 40. There is a series of openings 42.2 along the arm from the bearing end 33 towards the portion 28 and two series of openings along the portion 28.

Figure 5C:
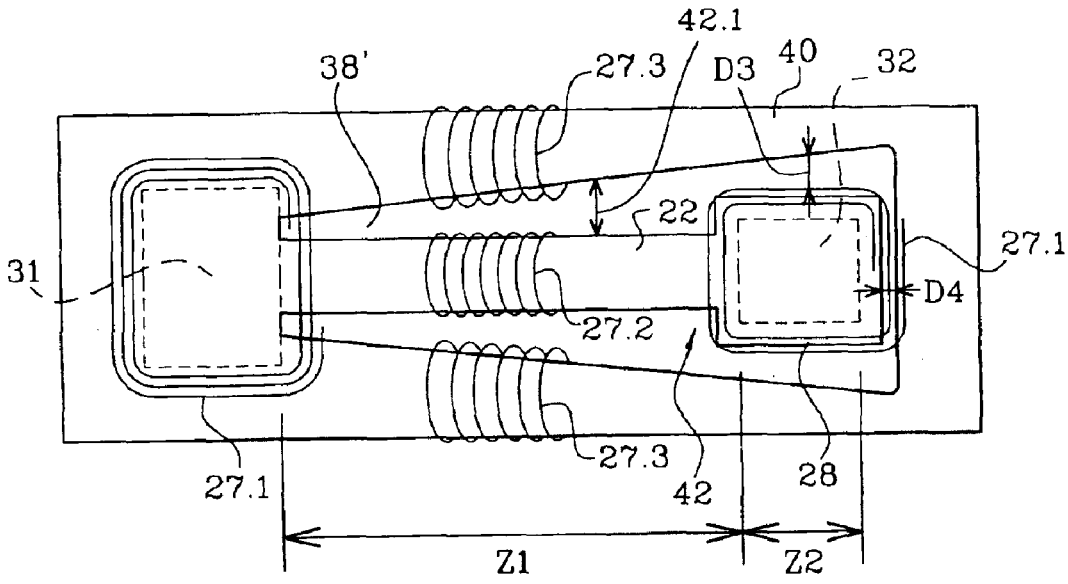
Figure 5D:
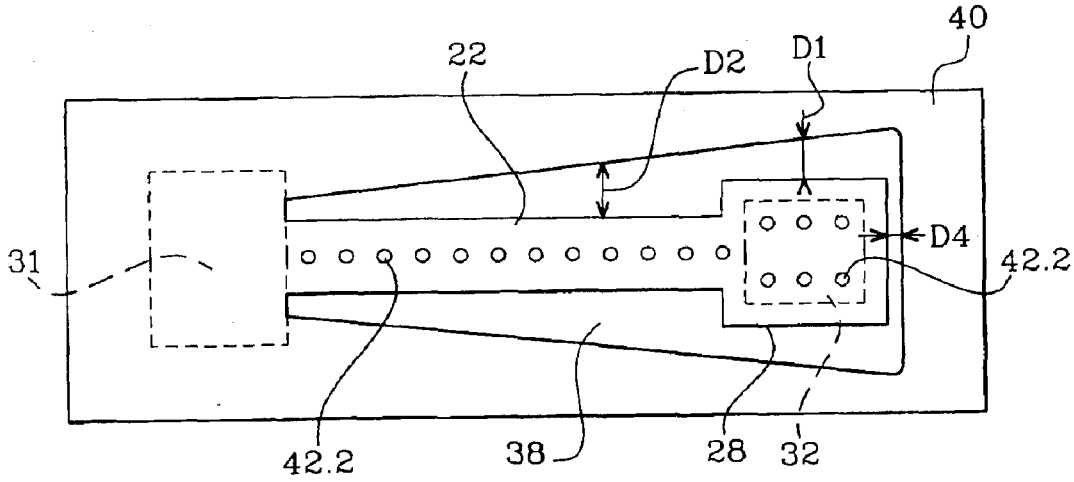

FIGS. 5C and 5D show two other configurations of the auxiliary air gap 38, derived from FIGS. 5A and 5B.

It can be seen that there is a risk that the mobile magnetic part 22 could displace laterally in the plane of the auxiliary air gap 38 to come into contact with the flux recuperation means 40, due to a mechanical instability caused by magnetic forces existing between the mobile magnetic part 22 and the flux recuperation means 40. The mobile magnetic part 22 could block in contact with the flux recuperation means 40. This would cause a malfunction and wear of the actuator.

To avoid this disadvantage, the dimension D3 of the auxiliary air gap 38 can be increased on each side of the mobile magnetic part 22, at the portion 28 contributing to delimiting the main air gap 29. However, the dimension D4 of the auxiliary air gap at the end of the mobile magnetic part 22 at the end of the arm, in the direction in which the magnetic flux is set up, remains minimal.

In these FIGS. 5, it is assumed that the first magnetic stud 31 and the second magnetic stud 32 project from the mobile magnetic part 22 instead of projecting from the fixed magnetic part 21. The flux recuperation means 40 are still magnetically and mechanically connected to the yoke 30 by the first magnetic stud 31. The second magnetic stud 32 then forms part of the portion 28 of the mobile magnetic part 22. The main air gap is delimited by the second magnetic stud 32 and by the portion of the yoke that is facing this second magnetic stud.

Still with the same objective of optimising the force applied to the portion 28, an attempt is made to limit flux leakages in the magnetic circuit 26, particularly between its different stacked levels. Flux leakages are due to the length of the magnetic circuit, the section of the magnetic material and circuit shape effects. Leakages in thin layer materials are greater than in solid materials.

However, it is always possible to make the yoke 30 (corresponding to a first level of the actuator) and/or the assembly formed by the mobile magnetic part 22 and the flux recuperation means 40 (corresponding to a second level of the actuator) into an oblong shape, approximately rounded at its two ends, in order to limit the shape effect. FIGS. 6A and 6B show top and bottom views respectively of an actuator according to the invention.

It is also possible to overlap the two levels, for this purpose. In the example shown in FIG. 6, the yoke 30 projects beyond the assembly of the mobile magnetic part 22 and the flux recuperation means 40, around a large part of its periphery. At least one through opening may also be provided on at least one of the levels to reduce facing surfaces. In the example, the yoke 30 is provided with a large and approximately central opening 43. This configuration is not limitative, and other configurations are possible.

We will now consider another example of a relay according to the invention. It is assumed that the relay was made by conventional technologies for assembly and machining of mechanical structures, and not by micro-technologies. This type of relatively solid relay is particularly suitable for high powers.

Figure 7A:
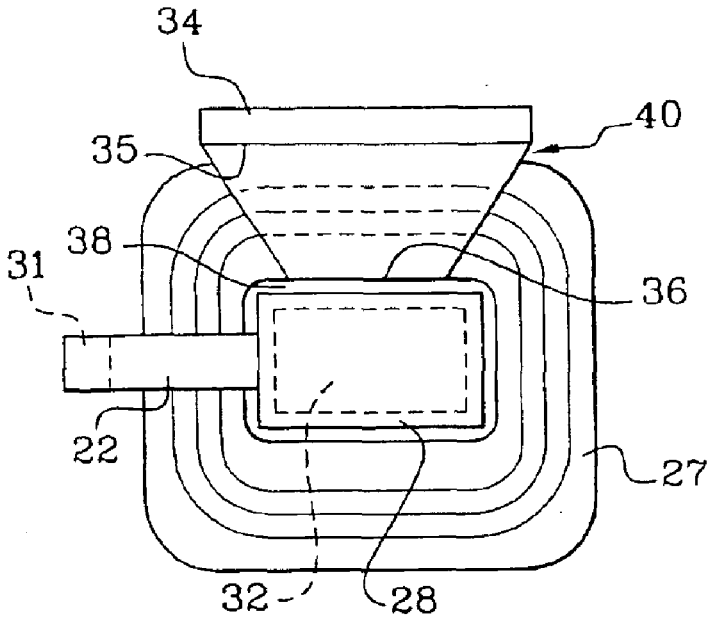
FIGS. 7A and 7B show a massive magnetic actuator.
Figure 7B:
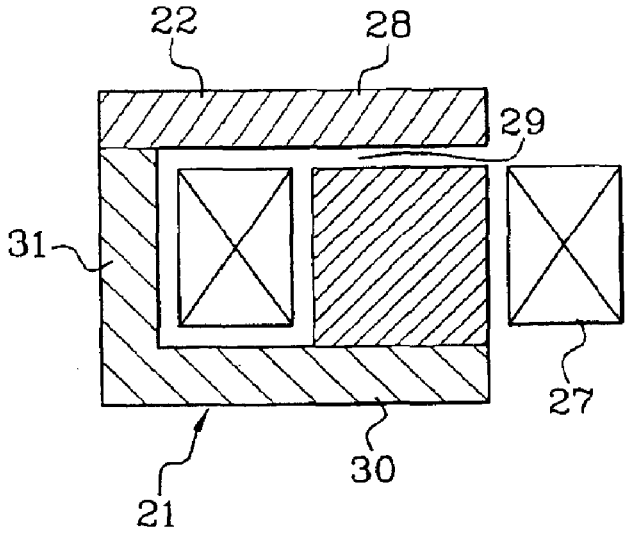

This relay is shown as a top view in FIG. 7A and as a sectional view in FIG. 7B. These figures also show the fixed magnetic part 21 with the yoke 30 magnetically and electrically connected to the mobile magnetic part 22 through the first support stud 31. The second stud 32 that contributes to delimiting the main air gap 29 is solid. The means for generating the magnetic flux 27 are made by a winding arranged around the second stud 32. The mobile magnetic part 22 is an arm with a bearing end 33 connected to the first stud 31 and a free end forming the portion 28 that is facing the second stud 32 to delimit the main air gap 29.

The flux recuperation means 40 are made by a solid arm mechanically and magnetically connected at one of its ends 35 to the yoke 30 through a third stud 34. Like the other two studs, this third stud 34 is a protuberance beyond the surface of the yoke 30. It would be possible for this third stud 34 to project from the flux recuperation means 40 instead of forming part of the yoke.

The other end 36 of the arm is not connected magnetically, it comes close to the mobile magnetic part 22 and contributes with it to delimiting the auxiliary air gap 38. The mobile magnetic part and the flux recuperation means were directed in approximately the same direction in the previous configurations, while in this configuration their directions are approximately perpendicular. There magnetic connection points with the yoke are separate.

In this configuration, it is assumed that the mobile magnetic part 22 and the second magnetic stud 32 conduct electricity and form part of an electrical circuit that is open when the actuator is open and closed when the actuator is closed.

Figure 7C:
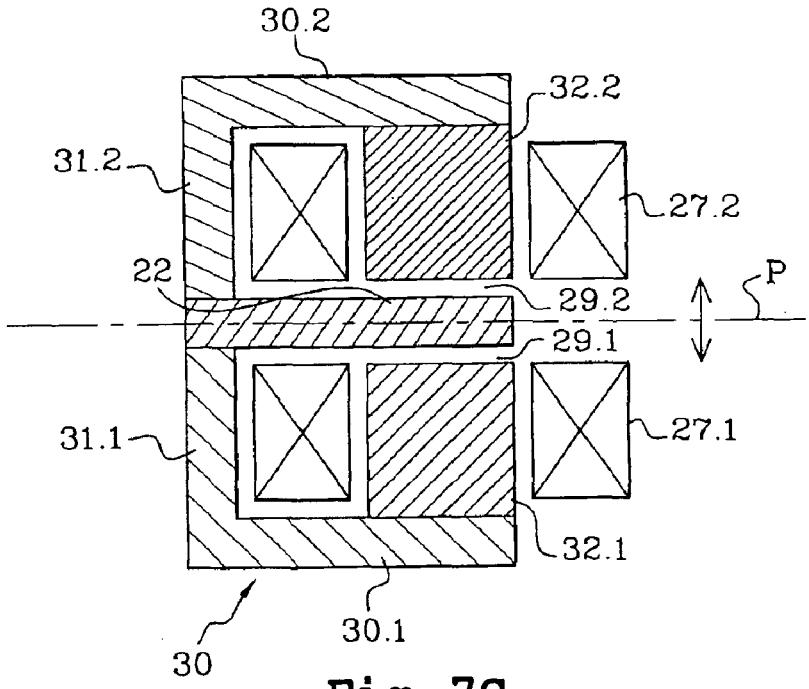
FIG. 7C shows a magnetic actuator symmetric about a median plane of the mobile magnetic part approximately perpendicular to the direction of movement.

The actuator according to the invention can be made symmetric about a median plane P passing through the mobile magnetic part 22 approximately perpendicular to the direction of movement (materialised by an arrow with two heads). A selector switch can thus be made. FIG. 7C illustrates this configuration. In this case the mobile magnetic part 22 is connected through its bearing end 33 to a yoke with two branches 30.1, 30.2 approximately parallel to each other, and this connection is made through the first two studs 31.1, 31.2 by extending one with respect to the other. The same is true for flux recuperation means 40. Each is magnetically connected to one branch 30.1, 30.2 of the yoke 30 through two third studs that are not shown in FIG. 7C, but are in line with each other.

There is also a pair of second studs 32.1, 32.2, each in line with the other, facing each other, each contributing to delimiting a main air gap 29.1, 29.2 with the mobile magnetic part 22. These air gaps are arranged in line with each other, on each side of the mobile magnetic part 22. The portion 28 of the mobile magnetic part 22 is the source of a force applied in one direction or in the opposite direction, so as to move the mobile magnetic part 22 towards one second stud 32.1 or the other second stud 32.2. The means for generating the magnetic flux are shown in the form of two windings 27.1, 27.2, the first 27.1 enabling the flux to be set up in one main air gap 28.1, and the second 27.2 enabling the flux to be set up in the other main air gap 28.2. Each of the windings 27.1, 27.2 surrounds one of the second studs 32.1, 32.2.

Two stable states of the actuator can be obtained if the second magnetic studs 32.1, 32.2 are made from a material with hysteresis.

Figure 7D:
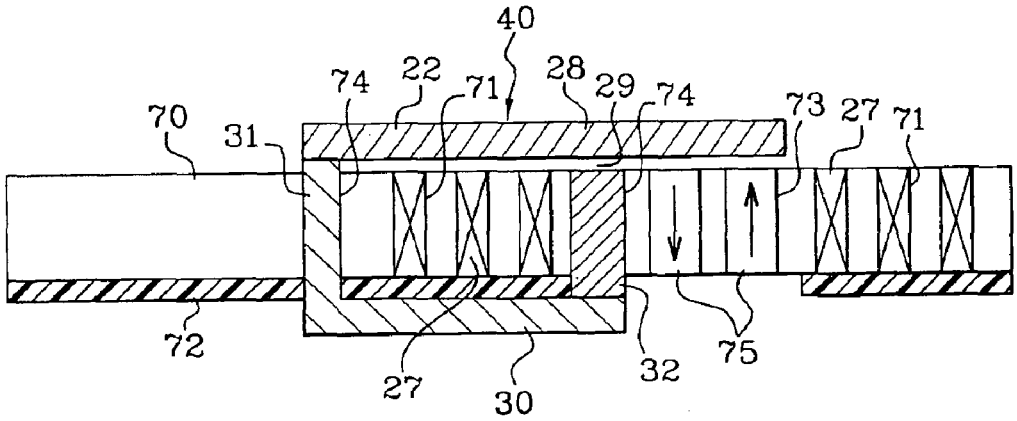
FIG. 7D shows a magnetic actuator made in micro-technologies.

FIG. 7D illustrates a relay with approximately the same structure but made in micro technology. For example, the starting point could be a silicon substrate 70. An opening 71 is etched in the substrate to create means for generating the magnetic flux 27 in the form of a spiral winding. It is filled with conducting material. An electrically insulating layer 72 is deposited on one faces of the substrate 70, at the spiral winding. At least one pair of holes 73 is drilled through the substrate 70, and the holes are filled with conducting material to make two electrical contacts 75 that will be electrically connected when the magnetic actuator is closed.

Other holes 74 are drilled through the substrate 70 and the insulating layer 72 to make studs 31, 32 and 34. They are filled with magnetic material. Care is taken to place the second stud 32 that contributes to delimiting the main air gap 29 in the central area of the winding. The third stud 34 is not visible, but it is similar to that shown in FIG. 7A.

The yoke 30 connected to studs 31, 32, 34 is also deposited on the face supporting the insulating layer 72. A sacrificial layer, for example made of silicon oxide, is deposited on the other face of the substrate 70, or it can be etched at the magnetic connecting studs 31, 34. A resin is deposited and photolithographed through a mask and is developed to create a caisson in which the mobile magnetic part 22 and the flux recuperation means 40 will be deposited. The sacrificial layer is then exposed under the mobile magnetic part so that it becomes free to move. The sacrificial layer is not shown in FIG. 7D, but it is located between the substrate 70 and the mobile magnetic part 22. The mobile magnetic part 22 masks the flux recuperation means.

The mobile magnetic part 22 is prolonged beyond the main air gap 29 to face two electrical contacts 75 supported by the substrate 70. When the actuator is closed, the two electrical contacts 75 are electrically connected through the free end of the mobile magnetic part 22. In this example, it is assumed that the mobile magnetic part or at least its free end are made from an electrically conducting magnetic material.

Figure 8A:
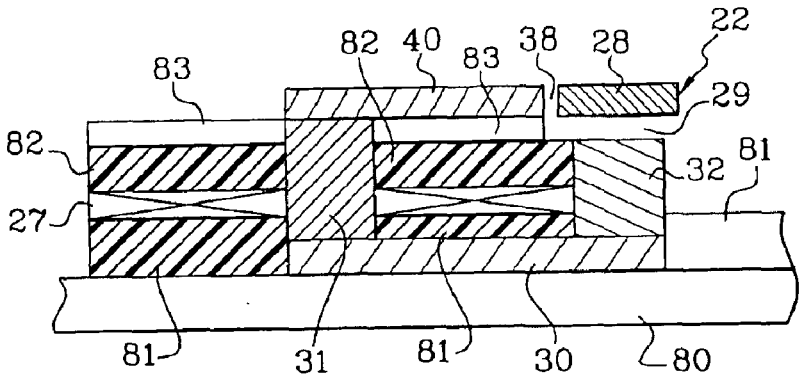
FIGS. 8A to 8D show a longitudinal sectional view and top views of a magnetic actuator with excellent mechanical stability in torsion.
Figure 8B:
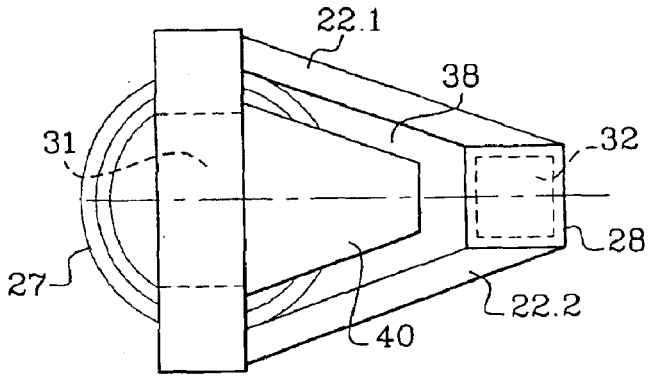
Figure 8C:
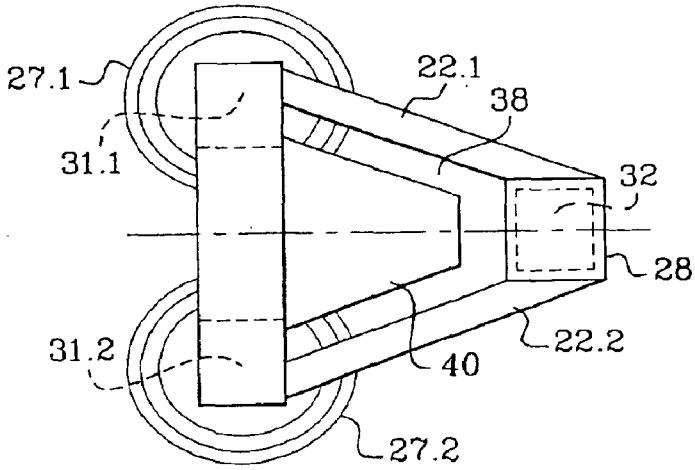

We will now describe another variant of a magnetic actuator according to the invention, with very good mechanical stability in torsion. Refer to FIGS. 8A to 8C.

These figures show the yoke 30 that is supported by a support 80 that may be made for example from glass, ceramic or silicon.

In FIG. 8B, it is provided with a first single stud 31 that creates the magnetic connection with the mobile magnetic part 22 and also with the flux recuperation means 40, and a second stud 32 that contributes to delimiting the main air gap 29.

In FIG. 8C, it is provided with a pair of first studs 31.1, 31.2 that firstly make its magnetic connection with the mobile magnetic part 22 and with the flux recuperation means 40, and a second stud 32 that contributes to delimiting the main air gap 29.

Figure 8D:
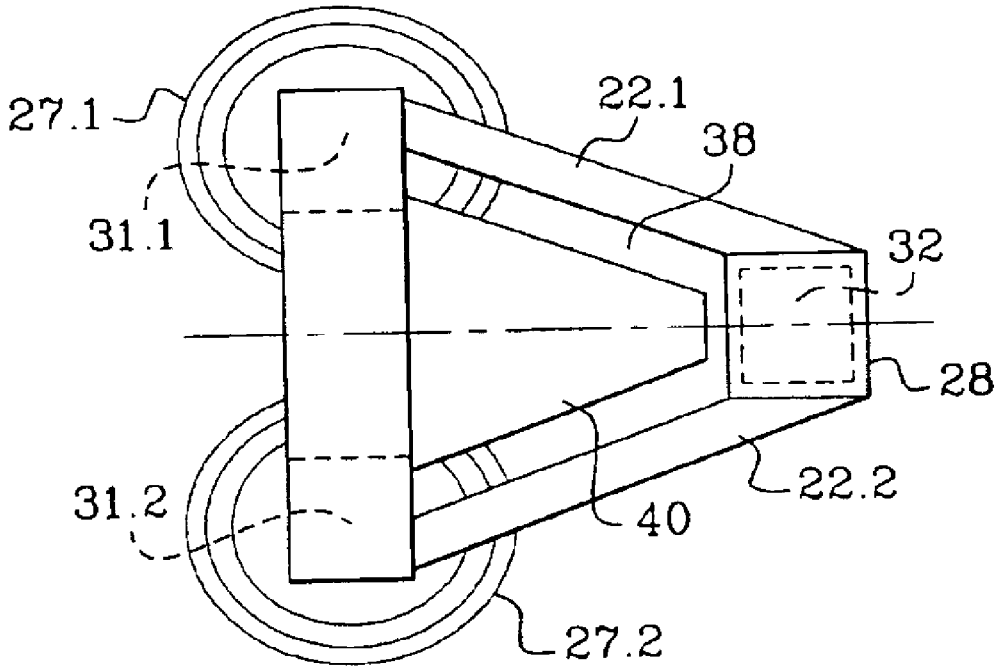

In FIG. 8D, the dimension of the auxiliary air gap in the direction in which the flux is set up is minimum at at least one area of the portion contributing to delimiting the main air gap.

The mobile magnetic part 22 is still in the form of an approximately plane arm but instead of being solid, the arm is composed of two non-parallel branches 22.1, 22.2. On one side, the branches 22.1, 22.2 are magnetically and mechanically connected either to the first single stud 31 or to one of the studs 31.1, 31.2 of the pair, and at the other side they join together to form the portion 28 that contributes to delimiting the main air gap 29.

The flux recuperation means 40 in this example are in the form of an approximately plane arm housed between two branches 22.1, 22.2 of the mobile magnetic part 22 approximately in the same plane.

The branches 22.1, 22.2 are approximately symmetrical about a longitudinal axis of the arm of the flux recuperation means 40. One end of this arm is magnetically and mechanically connected either to the first single stud 31, or to the pair of first studs 31.1, 31.2, and the other end is free. It moves towards the portion 28. It delimits the auxiliary air gap 38 with the mobile magnetic part 22. The means 27 for generating the flux are in the form of one or several windings. FIG. 8B shows a single winding 27 around the first single stud 31, while FIG. 8C shows a winding 27.1, 27.2 around each of the studs 31.1, 31.2 in the pair. A winding could have been added around the second stud 32.2

An actuator similar to that in FIG. 8B could be made in micro-technology, as described below with reference to FIGS. 13A to 13F.

Figure 13A:
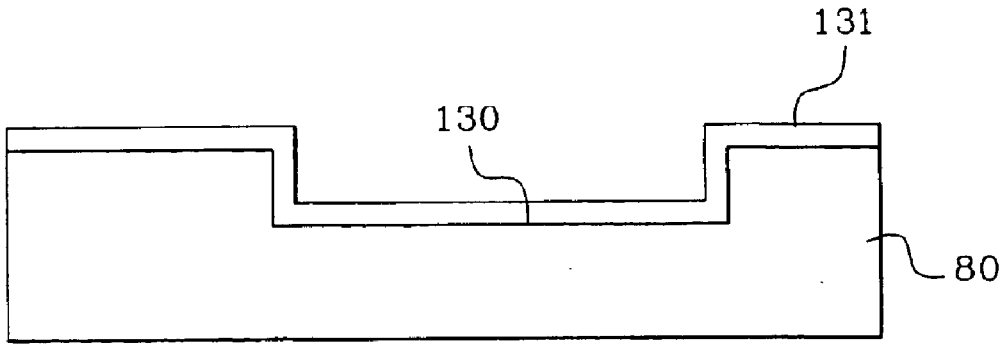
FIGS. 13A to 13F show different manufacturing steps of an actuator similar to that in FIG. 8A.

The yoke 30 will be made on the substrate 80. A resin layer is deposited, and a lithography step is then carried out. A caisson 130 is etched in the substrate 80 or in the layer deposited on the substrate. A conducting sub-layer 131 is deposited at the bottom of the caisson 130 (FIG. 13A).

Figure 13B:
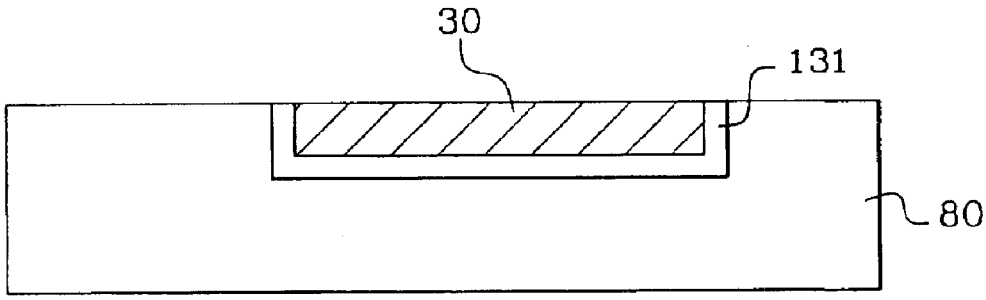

The yoke 30 is deposited electrolytically. The deposit is then made plane to keep the yoke 30 entirely in the caisson 130 (FIG. 13B).

Figure 13C:
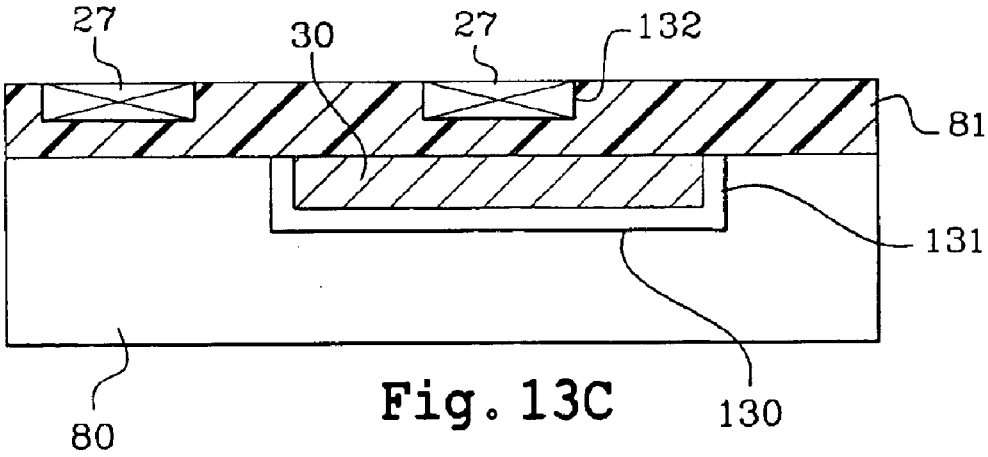

A dielectric layer 81, for example made of silicon oxide, is then deposited and at least one caisson 132 is etched to delimit the means 27 of generating the flux in the form of a coil with their electrical control studs. This etching is preceded by a lithography step. It does not reach the yoke 30. The conducting parts of the windings 27, for example made of copper, are deposited by electrolysis, this step is preceded by deposition of a conducting sub-layer and is followed by a planarisation step (FIG. 13C).

Figure 13D:
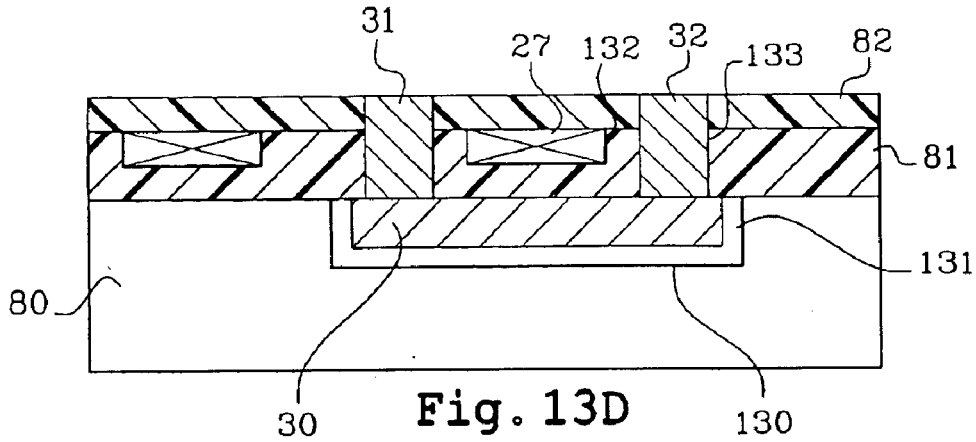

A new dielectric layer 82 is deposited. Caissons 133 are etched in the two dielectric layers 81, 82 to delimit the magnetic studs 31, 32. This etching is preceded by a lithography step. The caissons 133 reach the yoke 30. The magnetic studs 31, 32 are deposited by electrolysis, this step is preceded by depositing a conducting sub-layer and is followed by a planarisation step (FIG. 13D).

Figure 13E:
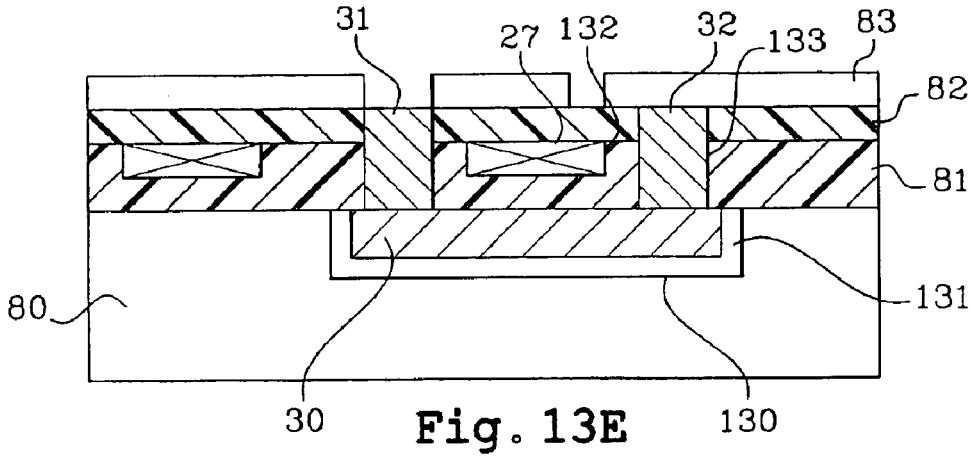

The next step is to deposit a sacrificial layer 83, for example made of silicon oxide, and it is then etched to expose the first magnetic stud 31 and to create a separation between the mobile magnetic part and the fixed magnetic part with the flux recuperation means that will be deposited (FIG. 13E).

Figure 13F:
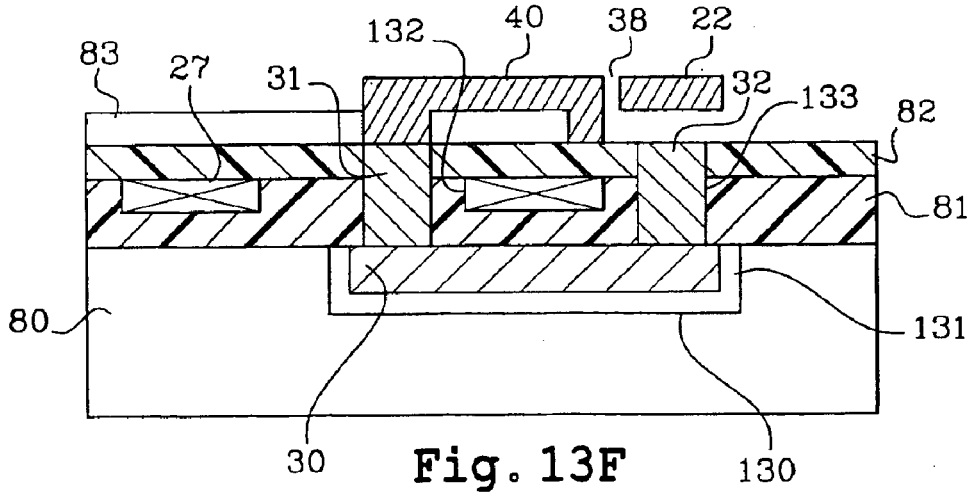

The next step is to deposit a layer of magnetic material to make the fixed magnetic part with flux recuperation means 40 and the mobile magnetic part 22, and they are delimited in a lithography and etching step. Finally, the sacrificial layer 83 is removed, for example by chemical etching, under the mobile magnetic part 22 to expose it (FIG. 13F).

The electrical control studs of the coils 27 are exposed (not shown). The actuator can be covered with a protective cover (not shown).

We will now describe examples of relays and electrical selector switches, giving details of their electrical contacts.

Figure 9A:
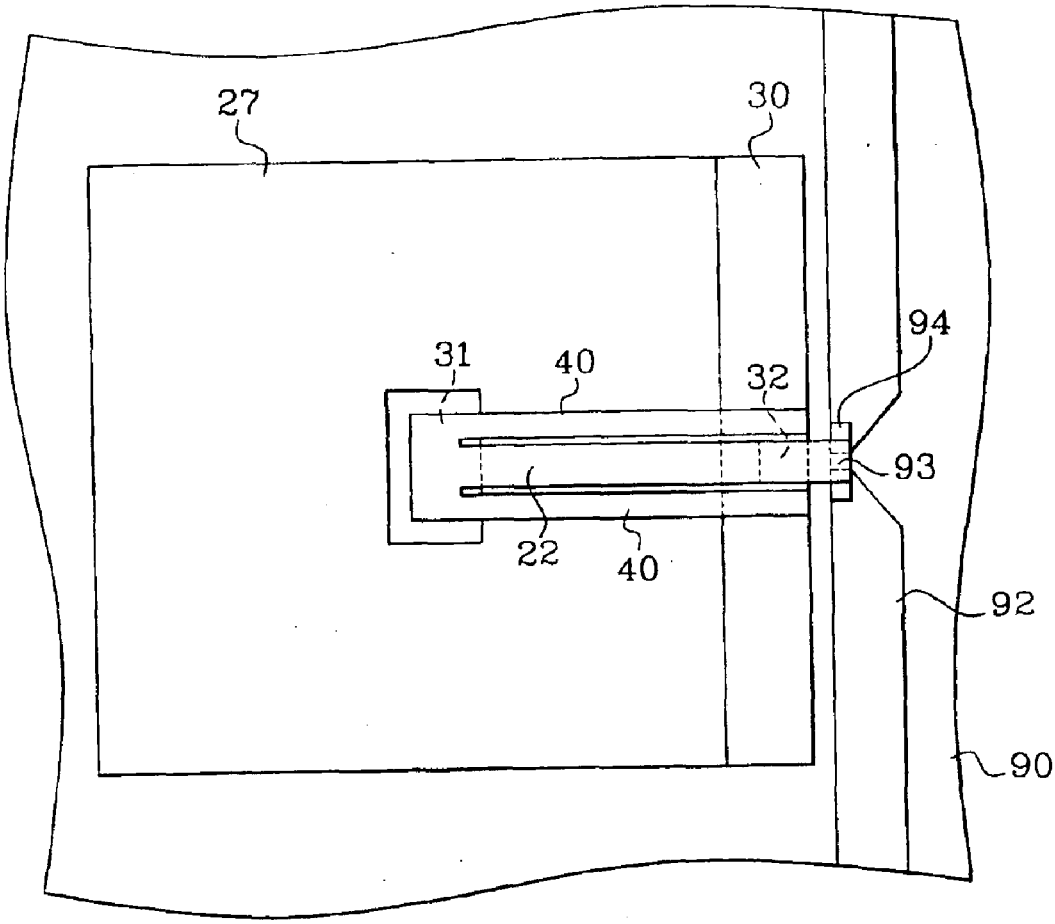
FIGS. 9A and 9B show a top view and a longitudinal sectional view respectively of an electrical relay according to the invention.
Figure 9B:
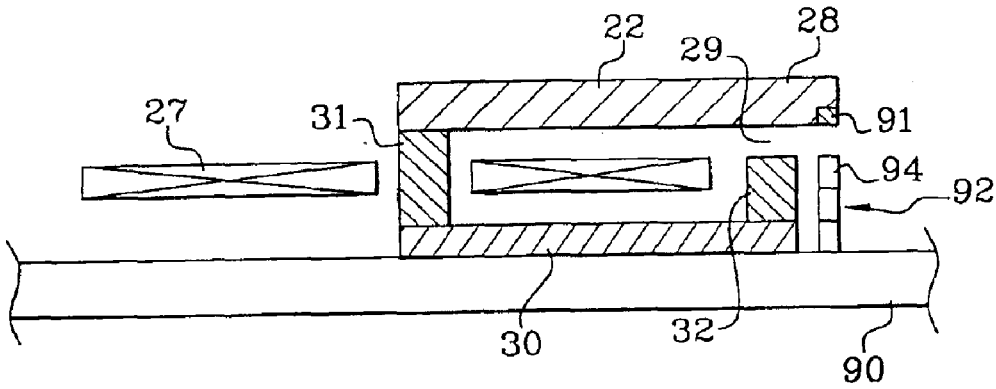

FIG. 9A shows a top view of an electrical relay comparable to that shown in FIG. 4A. The yoke 30 is supported by a substrate 90. The flux recuperation means 40 are visible, in the form of an arm with two branches. The mobile magnetic part 22 projects beyond the second magnetic stud 32 and its end is terminated by a mobile magnetic contact 91 offset from the main air gap 29. The substrate 90 on which the yoke 30 is supported comprises a discontinuous conducting track 92. The discontinuity 93 is located at the mobile electrical contact 91. When the actuator is in the closed state, the mobile electrical contact 91 contacts the conducting track 92 on each side of the discontinuity 93 so as to recreate continuity. It is assumed that the track 92 comprises a contact area 94 made of a material different from the material from which the track is made, on each side of the discontinuity 93. For example, this material could be gold, to improve the contact quality. The conducting track 92 may be a simple conducting line or for example a microstrip line. The microstrip line configuration is shown.

The portion 28 to which the force is applied and the mobile electrical contact 91 are offset from each other along the mobile magnetic part 22, but they remain in the same plane. They can be made in the same technological step. Thus, the smallest possible main air gap 29 can be kept for the case in which the distance between the electrical contact is included in the main air gap, when the actuator is in the open state and the maximum possible distance between the mobile electrical contact 91 and the track 92. The mobile electrical contact 91 may be arranged at any location of the mobile magnetic part and it is sized independently of the size of the mobile magnetic part. There is sufficient space to adjust the level of the track 91 on substrate 90. This is an advantageous construction to increase the relay closing force.

Figure 10A:
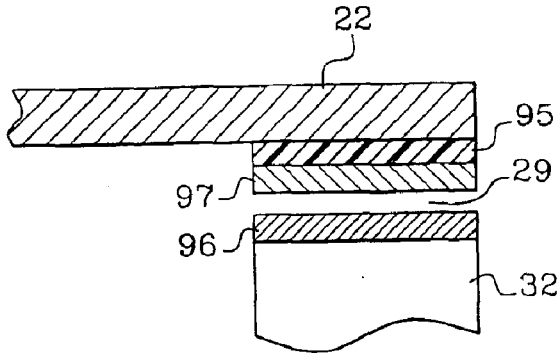
FIGS. 10A to 10C show different variants of the electrical contact of an actuator according to the invention.
Figure 10B:
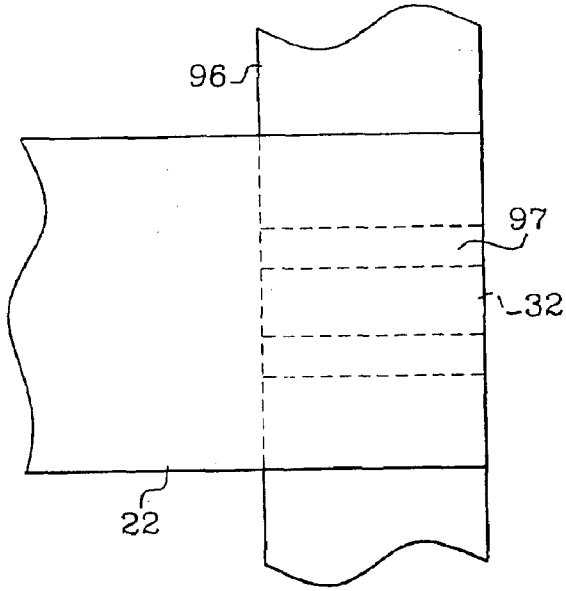
Figure 10C:
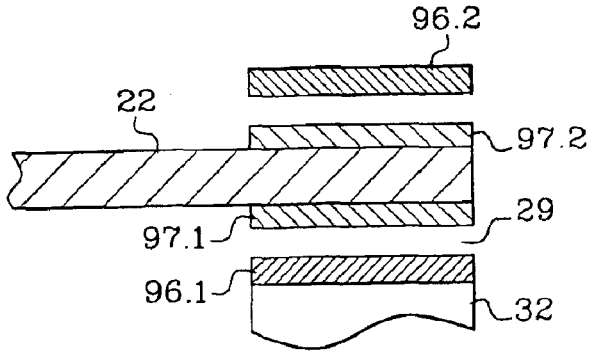

It would be possible to make the electrical contact at the main air gap 29. This variant is illustrated in FIGS. 10A, 10B and 10C.

A mobile electrical contact 97 is fixed to the mobile magnetic part 22 at the level of the portion 28 at which the force generated by the magnetic flux is located. This mobile electrical contact 97 is electrically isolated from the mobile magnetic part 22 by an insulating layer 95. This insulating layer 95 can be removed if the mobile magnetic part 22 is electrically conducting and if this property is used. In this case, the mobile magnetic part 22 can be electrically isolated from the remainder of the magnetic actuator. It can thus itself be used for transmission of an electrical signal, the mobile electrical contact closing an electrical circuit integrating the mobile magnetic part.

It would be possible for the electrical contact to be made by the magnetic material itself as illustrated in FIGS. 11.

A discontinuous conducting track 96 is shown facing the mobile contact 97. It is located between the second magnetic stud 32 and the mobile contact 97. Contact areas on the track to improve the contact quality are not shown in this configuration. With this configuration, the main air gap 29 is increased and electrically conducting or insulating layers are added between the mobile magnetic part 22 and the second magnetic stud 32, while the space between the electrical contacts is kept approximately constant. The method for making the actuator can be simplified, despite the increase in the air gap.

It would be possible for the mobile magnetic part 22 to be fitted with two mobile electrical contacts 97.1, 97.2, so that the actuator can operate as a selector switch. These contacts are placed approximately symmetrically about a median plane of the mobile magnetic part 22 approximately perpendicular to the movement direction. Each is intended to close an electrical circuit, shown schematically by a contact area 96.1, 96.2, these circuits being located on each side of the mobile magnetic part 22. By generating a magnetic flux in the main air gap 29 in one direction or the other, the mobile magnetic part 22 is moved in one direction or the opposite direction, and one of the mobile electrical contacts 97.1, 97.2 closes one of the electrical circuits.

As shown in FIG. 10A, the fixed contact area 96.1 is located between the second magnetic stud 32 and the mobile electrical contact 97.1. The insulating layer between the mobile magnetic pant 22 and the mobile electrical contacts 97.1, 97.2 are not shown in this view.

Figure 11A:
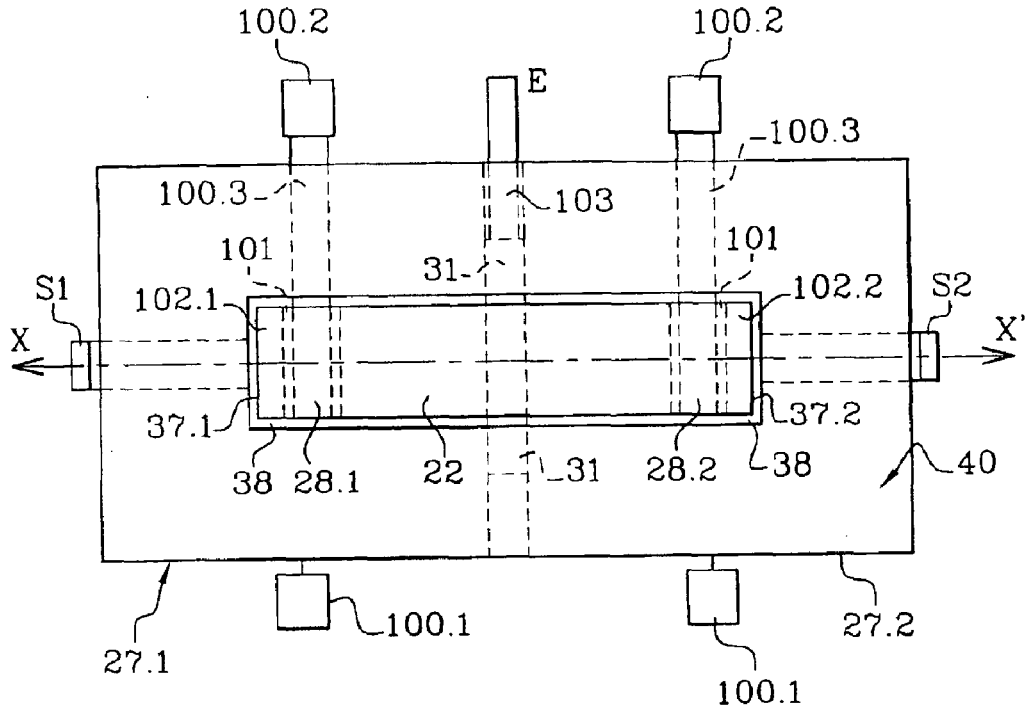
FIGS. 11A and 11B show a top view and a sectional view respectively, of an electrical switch according to the invention.
Figure 11B:
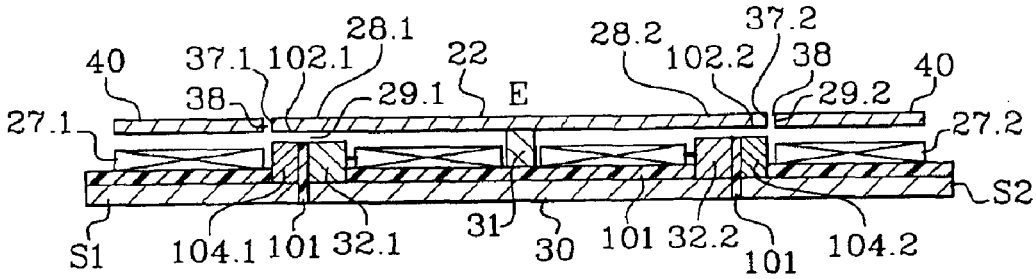

A switch can also be made by placing the anchor for the mobile magnetic part 22 in its central part instead of placing it at one of its ends. FIGS. 11A and 11B illustrate this variant. The mobile magnetic part 22 now acts as a balance with two free ends 37.1, 37.2. It comprises two portions 28.1 and 28.2, each of which contributes to delimiting a main air gap 29.1, 29.2 and these portions are located at the side of its two free ends 37.1, 37.2.

The yoke 30 is now provided with a first central anchor magnetic stud 31 and a pair of second studs 32.1, 32.2 each of which contributes to delimiting one of the main air gaps 29.1, 29.2. It is made from an electrically conducting magnetic material. In this example, it is assumed that the first central magnetic stud 31 is also used to magnetically connect the flux recuperation means 40 to the yoke 30. Flux recuperation means 40 are comparable with those shown in FIGS. 6. The means for generating the magnetic flux 27 are in the form of a pair of coils 27.1, 27.2 each surrounding one of the second studs. References 100.1 and 100.2 show the electrical terminals for power supply to the coils. Terminals 100.1 are electrically connected directly to one end of the conductor of a coil 27.1, 27.2, while the terminals 100.2 are connected through a conductor 100.3 and through one of the second magnetic studs 32.1, 32.2 to the other end of the conductor of a winding 27.1, 27.2.

The coils 27.1, 27.2 are electrically isolated from the yoke 30 by a dielectric layer 101 that also extends between the first magnetic stud 31 and the yoke.

The mobile magnetic part 22 comprises an area 28.1, 28.2 on which the force is applied when the selector switch is actuated, at its free ends 37.1, 37.2. This area 28.1, 28.2 faces each of the second studs 32.1, 32.2 and contributes to delimiting the main air gap 29.1, 29.2.

The two free ends 37.1, 37.2 terminate by a mobile electrical contact area 102.1, 102.2. It is assumed that the mobile magnetic part 22 and the first magnetic stud 31 conduct electricity. The first magnetic stud is connected to an input conductor E that transfers an electrical signal to the mobile magnetic part 22. There is a fixed electrical contact 104.1, 104.2 facing each electrical contact area 102.1, 102.2, that electrically isolates the second magnetic stud 32.1, 32.2 by a dielectric layer 101. This electrical contact is prolonged by an output conductor S1, S2. The mobile magnetic part contacts one of the fixed electrical contacts 104.1, 104.2, the electrical signal can be collected on one of the output conductors S1 or S2. The coils 27.1, 27.2 are also electrically isolated from the output conductors S1, S2.

The right part of FIG. 11B diagrammatically shows the passage of electrical signals and the passage of the magnetic flux. In this example, the electrical signal passes through the mobile magnetic part, but neither through the second magnetic stud nor through the yoke. It could have been imagined that it would pass through these parts of the magnetic circuit.

The coils may be independent or they may be electrically connected in series, for example opposite coils can be in series if materials with remanent magnetisation or materials with hysteresis are used.

Figure 12A:
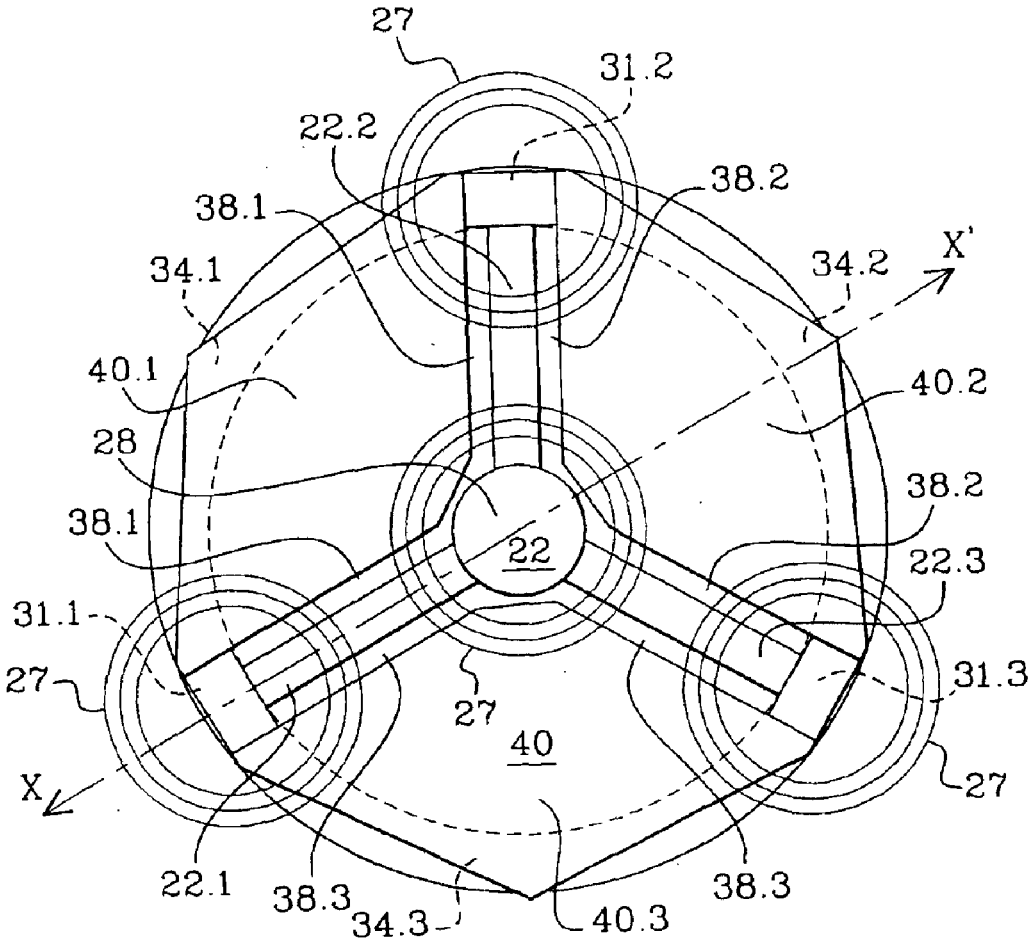
FIGS. 12A and 12B show a top view and a sectional view respectively, of a pump according to the invention.
Figure 12B:
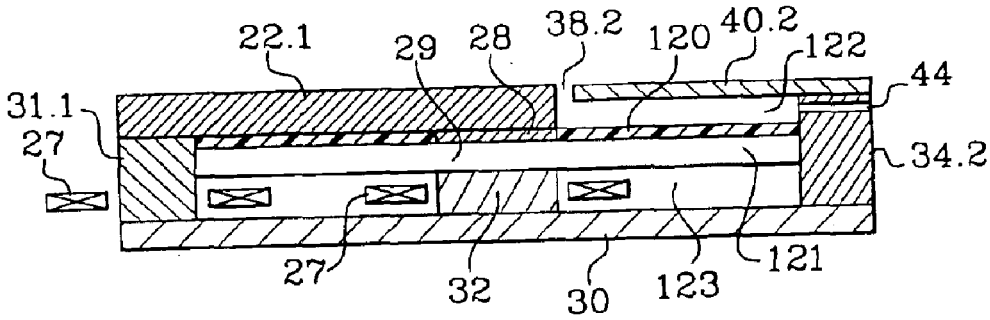

FIGS. 12A, 12B now illustrate an actuator according to the invention in a pump application and more particularly a micro-pump application.

The mobile magnetic part 22 formed of several branches 22.1, 22.2, 22.3 is in star configuration. The centre 28 of the star contributes to delimiting the main air gap 29. It may be in the form of a magnetic stud marked with the same reference 28. The ends of the branches 22.1, 22.2, 22.3 are bearing ends magnetically and mechanically connected to the single yoke 30. For example, the yoke may be in the form of a disk. The yoke is provided with a series of first studs 31.1, 31.2, 31.3 to connect it to the mobile magnetic part 22. It also comprises a second central stud 32 that contributes to delimiting the main air gap 29 and a series of third studs 34.1, 34.2, 34.3 to magnetically and mechanically connect it to the flux recuperation means 40.1, 40.2, 40.3. These flux recuperation means contribute to delimiting an auxiliary air gap 38.1, 38.2, 38.3 with the mobile magnetic part 22. They occupy the space between two contiguous branches by remaining separated from the branches.

In this pump configuration, it is assumed that the upper part of the first studs and the third studs are contiguous, so as to form a peripheral ring around the yoke 30 onto which a membrane 120 is fixed. This membrane 120 is also fixed to the mobile magnetic part 22 and the stud 28, but not to the flux recuperation means 40. This membrane moves at the same rate as the displacements of the mobile magnetic part 22. It is used to actuate circulation of a fluid. It may have a compression, suction or ejection effect on the fluid. It is made from a material compatible with the fluid to be pumped or is protected by a surface treatment.

In the example in FIGS. 12, the membrane 120 contributes to delimiting a first cavity 121 on one side with the yoke 30. The auxiliary air gaps 38.1, 38.2, 38.3 can be used as orifices contributing to fluid circulation, for ejection or suction in an actuation cavity 122 located between the other side of the membrane 120 and the flux recuperation means 40. At least one other orifice 44 also contributing to fluid circulation could pass through the ring and open up into the actuation cavity 122. A valves system (not shown) would be used so that the fluid can circulate appropriately.

The means for generating the magnetic flux are shown in the form of coils 27 surrounding the first magnetic studs 31.1, 31.2, 31.3 and the second magnetic stud 32. A sealing layer 123 coats the coils 27 between the yoke 30 and the magnetic studs 31.1, 31.2, 31.3, 32, 34.1, 34.2, 34.3 so as to isolate them from the cavity 121.

Other configurations are possible, and in particular the fluid could be located in a tank inside the pump in which there would be at least one orifice through which it could be ejected.

This type of structure could be used like a relay, if the membrane is eliminated.

What is claimed is:

1. Magnetic actuator having a closed magnetic circuit (26) capable of guiding a magnetic flux, this magnetic circuit (26) comprising a fixed magnetic part (30, 31, 32) with a yoke (30) and a mobile magnetic part (22), magnetically connected to each other and also at least one main air gap (29) delimited by at least one portion (28) of the mobile magnetic part (22) and by the yoke (30), in which the magnetic flux is closed by being set up approximately transverse to the mobile magnetic part (22), characterised in that the fixed magnetic part (30, 31, 32) comprises flux recuperation means (40) that contribute with the mobile part (22) to delimiting an auxiliary air gap (38) in which the magnetic flux is set up laterally to the mobile part (22), the magnetic flux being contained on each side of the main air gap (29), on one side by the yoke (30), and on the other side jointly by the mobile part (22) and the flux recuperation means (40) through the part (28) contributing to delimiting the main air gap (29), the dimension of the auxiliary air gap (38) in the direction in which magnetic flux is set up being a minimum in at least one area of the portion (28) contributing to delimiting the main air gap (29).

2. Magnetic actuator according to claim 1, characterised in that at least one first magnetic stud (31) is used to connect the yoke (30) mechanically and magnetically to the mobile magnetic part (22).

3. Magnetic actuator according to claim 2, characterised in that at least one second magnetic stud (32) contributes to delimiting the main air gap (29), and this magnetic stud (32) is made from a material with hysteresis.

4. Magnetic actuator according to claim 2, characterised in that at least one other magnetic stud (34) is used to mechanically and magnetically connect the yoke (30) to the flux recuperation means (40).

5. Magnetic actuator according to claim 1, characterised in that it comprises means (27) for generating the magnetic flux in the closed magnetic circuit (26), these means for generating the magnetic flux being made by at least one winding.

6. Magnetic actuator according to claim 1, characterised in that the mobile magnetic part (22) is globally in the form of at least one arm with one or several non-parallel branches connected to each other at the portion contributing to delimiting the main air gap (29).

7. Magnetic actuator according to claim 1, characterised in that the mobile magnetic part (22) is in the form of a star with several branches (22.1, 22.2, 22.3).

8. Magnetic actuator according to claim 1, characterised in that the thickness (E1) of the flux recuperation means (40) in the direction of movement of the mobile magnetic part (22) is more than the thickness (E2) of the mobile magnetic part (22) in the displacement direction, so that the auxiliary air gap (38) is delimited by surfaces that remain facing each other during the movement of the mobile magnetic part (22).

9. Magnetic actuator according to claim 1, characterised in that the main air gap (29) is defined by two facing surfaces (S1, S2), the first surface (S1) forming part of the portion (28) of the mobile magnetic part (22) and the second surface (S2) forming part of the yoke (30), the first surface (S1) being larger than the second surface (S2) and projecting all around the second surface (S2).

10. Magnetic actuator according to claim 1, characterised in that the dimension (D2) of the auxiliary air gap (38) in the direction in which the magnetic flux is set up is practically maximum close to the portion (28) contributing to delimiting the main air gap (29), and decreases as the distance from this portion increases.

11. Magnetic actuator according to claim 1, characterised in that the mobile magnetic part (22) comprises at least one through opening (42.2) in the direction of displacement.

12. Magnetic actuator according to claim 1, characterised in that the yoke (30) forms a first level of the actuator and the assembly formed by the flux recuperation means (4) and by the mobile magnetic part (22) forms a second level, the two levels being stacked.

13. Magnetic actuator according to claim 12, characterised in that at least one of the levels has an oblong shape approximately rounded at its two ends.

14. Magnetic actuator according to claim 12, characterised in that the two levels overlap.

15. Magnetic actuator according to claim 12, characterised in that at least one of the levels comprises a central through opening (43).

16. Magnetic actuator according to claim 1, characterised in that it is approximately symmetric about a median plane (P) passing through the mobile magnetic part (22) approximately perpendicular to the movement direction.

17. Magnetic actuator according to claim 1, characterised in that the portion (28) contributing to delimiting the main air gap (29) comprises at least one electrical contact (97) that will contact at least one other electrical contact (96) when the actuator is closed.

18. Magnetic actuator according to claim 1, characterised in that the mobile magnetic part (22) is terminated by at least one electrical contact (91) offset from the portion (28) contributing to delimiting the main air gap (29), this electrical contact being designed to contact at least one other electrical contact when the actuator is closed.

19. Magnetic actuator according to claim 17, characterised in that the electrical contact (97) is electrically isolated from the mobile magnetic part (22).

20. Magnetic actuator according to claim 1, characterised in that the mobile magnetic part (22) is made of an electrically conducting magnetic material and acts as an electrical contact.

21. Method for making a magnetic actuator according to claim 1, characterised in that it comprises the following steps:

- etch a caisson (130) in a substrate (80) to be filled with a magnetic material to make a yoke (30) from a fixed magnetic part (30, 31, 32),
- deposit a first dielectric layer (81) on the substrate (80) with the yoke (30),
- etch at least one caisson (132) to delimit the means (27) of generating a magnetic flux and deposit the said means (27),
- deposit a second dielectric layer (82) on the first layer (81),
- etch caissons (133) through the two layers (81, 82) reaching the yoke (30) to delimit at least one first magnetic stud (31) and at least one second magnetic stud (32), the second stud (32) contributing to delimiting at least one main air gap (29), deposit first and second magnetic studs (31, 32) in the caissons (133), deposit a sacrificial layer (83) on the second dielectric layer (82) and etch the sacrificial layer (83) to expose the first magnetic stud (31) and to make a separation between a mobile magnetic part (22) and flux recuperation means (40) of the fixed magnetic part, deposited later, deposit magnetic material on the sacrificial layer (83) to make the mobile magnetic part (22) and flux recuperation means (27), then etch the magnetic material to delimit them, eliminate the sacrificial layer (83) under the mobile magnetic part (22) to expose it and make the main air gap (26).

22. Relay characterised in that it comprises a magnetic actuator according to claim 1.

23. Selector switch characterised in that it comprises at least one magnetic actuator according to claim 1, so as to have several main air gaps (29.1, 29.2).

24. Pump characterised in that it comprises a magnetic actuator according to claim 1, in which the mobile magnetic part (22) is fixed to a membrane (120) that contributes to delimiting a cavity (122) in which a fluid can be circulated.

* * * * *